US010513929B2

(12) United States Patent
Moradi et al.

(10) Patent No.: US 10,513,929 B2
(45) Date of Patent: Dec. 24, 2019

(54) COMPRESSOR TURBINE BLADE AIRFOIL PROFILE

(71) Applicant: PRATT & WHITNEY CANADA CORP., Longueuil (CA)

(72) Inventors: Niloofar Moradi, COte Saint Luc (CA); Krishan Mohan, Brossard (CA); Panagiota Tsifourdaris, Montreal (CA); Sami Girgis, Hawkesbury (CA); Vincent Paradis, Longueuil (CA); Robert Huszar, Beloeil (CA); Jasrobin Grewal, Pincourt (CA)

(73) Assignee: Pratt & Whitney Canada Corp., Longueuil, Quebec (CA)

( * ) Notice: Subject to any disclaimer, the term of this patent is extended or adjusted under 35 U.S.C. 154(b) by 191 days.

(21) Appl. No.: 15/692,388

(22) Filed: Aug. 31, 2017

(65) Prior Publication Data

US 2019/0063226 A1 Feb. 28, 2019

(51) Int. Cl.

| | |
|---|---|
| ***F01D 5/14*** | (2006.01) |
| ***F01D 5/28*** | (2006.01) |
| ***F01D 15/08*** | (2006.01) |

(52) U.S. Cl.

CPC ..... *F01D 5/141* (2013.01); *F01D 5/288* (2013.01); *F01D 15/08* (2013.01); *F05D 2240/24* (2013.01); *F05D 2250/74* (2013.01)

(58) Field of Classification Search

CPC ... F01D 5/12; F01D 5/14; F01D 5/141; F01D 5/288; F05D 2250/74

See application file for complete search history.

(56) References Cited

U.S. PATENT DOCUMENTS

| | | | |
|---|---|---|---|
| 6,398,489 | B1 | 6/2002 | Burdgick et al. |
| 6,832,897 | B2 | 12/2004 | Urban |
| 6,854,961 | B2 | 2/2005 | Zhang et al. |
| 6,910,868 | B2 | 6/2005 | Hyde et al. |
| 7,306,436 | B2 | 12/2007 | Girgis et al. |
| 7,351,038 | B2 | 4/2008 | Girgis et al. |
| 7,354,249 | B2 | 4/2008 | Girgis et al. |
| 7,367,779 | B2 | 5/2008 | Girgis et al. |
| 7,402,026 | B2 | 7/2008 | Girgis et al. |
| 7,520,726 | B2 | 4/2009 | Papple et al. |
| 7,520,727 | B2 | 4/2009 | Sreekanth et al. |
| 7,520,728 | B2 | 4/2009 | Sleiman et al. |
| 7,534,091 | B2 | 5/2009 | Ravanis et al. |
| 7,537,432 | B2 | 5/2009 | Marini et al. |
| 7,537,433 | B2 | 5/2009 | Girgis et al. |
| 7,559,746 | B2 | 7/2009 | Tsifourdaris et al. |
| 7,559,747 | B2 | 7/2009 | Mohan et al. |
| 7,559,748 | B2 | 7/2009 | Kidikian et al. |
| 7,559,749 | B2 | 7/2009 | Kidikian et al. |

(Continued)

*Primary Examiner* — Christopher Verdier
*Assistant Examiner* — Elton K Wong
(74) *Attorney, Agent, or Firm* — Norton Rose Fulbright Canada L.L.P.

(57) ABSTRACT

A compressor turbine includes a series of compressor turbine blades each having an airfoil with a profile substantially in accordance with at least an intermediate portion of the Cartesian coordinate values of X, Y and Z set forth in Table 2. The X and Y values are distances, which when smoothly connected by an appropriate continuing curve, define airfoil profile sections at each distance Z. The profile sections at each distance Z are joined smoothly to one another to form a complete airfoil shape.

8 Claims, 4 Drawing Sheets

(56) References Cited

U.S. PATENT DOCUMENTS

| | | | | |
|---|---|---|---|---|
| 7,566,200 | B2 | 7/2009 | Marini et al. | |
| 7,568,889 | B2 | 8/2009 | Mohan et al. | |
| 7,568,890 | B2 | 8/2009 | Findlay et al. | |
| 7,568,891 | B2 | 8/2009 | Mohan et al. | |
| 7,611,326 | B2 | 11/2009 | Trindade et al. | |
| 7,625,182 | B2 | 12/2009 | Mah et al. | |
| 7,625,183 | B2 | 12/2009 | Tsifourdaris et al. | |
| 7,632,074 | B2 | 12/2009 | Ravanis et al. | |
| 8,100,659 | B2 | 1/2012 | Marini | |
| 8,105,043 | B2 | 1/2012 | Tsifourdaris | |
| 8,105,044 | B2 | 1/2012 | Marini et al. | |
| 2005/0079061 | A1 | 4/2005 | Beddard | |
| 2008/0124219 | A1 | 5/2008 | Kidikian et al. | |
| 2009/0097982 | A1 | 4/2009 | Saindon et al. | |
| 2009/0116967 | A1 | 5/2009 | Sleiman et al. | |
| 2010/0008784 | A1 | 1/2010 | Shafique et al. | |
| 2011/0229317 | A1 | 9/2011 | Marini | |
| 2011/0236214 | A1 | 9/2011 | Tsifourdaris | |
| 2011/0243747 | A1 | 10/2011 | Marini | |
| 2011/0243748 | A1 | 10/2011 | Tsifourdaris | |
| 2011/0262279 | A1* | 10/2011 | Marini | F01D 5/141 416/223 A |
| 2016/0115797 | A1* | 4/2016 | Calla | F01D 5/288 428/681 |

* cited by examiner

COMPRESSOR TURBINE BLADE AIRFOIL PROFILE

TECHNICAL FIELD

The application relates generally to a blade airfoil for a gas turbine engine and, more particularly, to an airfoil profile suited for use in a turbine blade assembly of a compressor turbine.

BACKGROUND OF THE ART

Every stage of a gas turbine engine must meet a plurality of design criteria to assure the best possible overall engine efficiency. The design goals dictate specific thermal and mechanical requirements that must be met pertaining to heat loading, parts life and manufacturing, use of combustion gases, throat area, vectoring, the interaction between stages to name a few. The design criteria for each stage is constantly being re-evaluated and improved upon. Each airfoil is subject to flow regimes which lend themselves easily to flow separation, which tend to limit the amount of work transferred to the compressor, and hence the total thrust or power capability of the engine. The compressor turbine is also subject to harsh temperatures and pressures, which require a solid balance between aerodynamic and structural optimization. Therefore, improvements in airfoil design are sought.

SUMMARY

In one aspect, the present application provides a turbine blade for a gas turbine engine having a gaspath, the blade comprising an airfoil having an intermediate portion contained within the gaspath and defined by a nominal profile substantially in accordance with Cartesian coordinate values of X, Y, and Z of Sections 2 to 9 set forth in Table 2, wherein the point of origin of the orthogonally related axes X, Y and Z is located at an intersection of a centerline of the gas turbine engine and a stacking line of the turbine blade, the Z values are radial distances measured along the stacking line, the X and Y are coordinate values defining the profile at each distance Z.

In another aspect, the present application provides a turbine blade for a gas turbine engine having a gaspath, the turbine blade having a cold coated intermediate airfoil portion contained within the gaspath and defined by a nominal profile substantially in accordance with Cartesian coordinate values of X, Y, and Z of Sections 2 to 9 set forth in Table 2, wherein the point of origin of the orthogonally related axes X, Y and Z is located at an intersection of a centerline of the gas turbine engine and a stacking line of the turbine blade, the Z values are radial distances measured along the stacking line, the X and Y are coordinate values defining the profile at each distance Z.

In another aspect, the present application provides a turbine rotor assembly for a gas turbine engine having a gaspath, the assembly comprising a plurality of blades, each blade including an airfoil having an intermediate portion contained with the gaspath of the engine and defined by a nominal profile substantially in accordance with Cartesian coordinate values of X, Y, and Z of Sections 2 to 9 set forth in Table 2, wherein the point of origin of the orthogonally related axes X, Y and Z is located at an intersection of a centerline of the gas turbine engine and a stacking line of the turbine blade, the Z values are radial distances measured along the stacking line, the X and Y are coordinate values defining the profile at each distance Z.

In a still further aspect of the present application, there is provided a compressor turbine blade comprising at least one airfoil having a surface lying substantially on the points of Table 2, the airfoil extending from a platform defined generally by some of the ID gaspath coordinates given in Table 1, wherein a fillet radius is applied around the airfoil between the airfoil and the platform.

Further details of these and other aspects of the present application will be apparent from the detailed description and figures included below.

DESCRIPTION OF THE DRAWINGS

Reference is now made to the accompanying figures depicting aspects of the present invention, in which.

DETAILED DESCRIPTION

Figure 1:
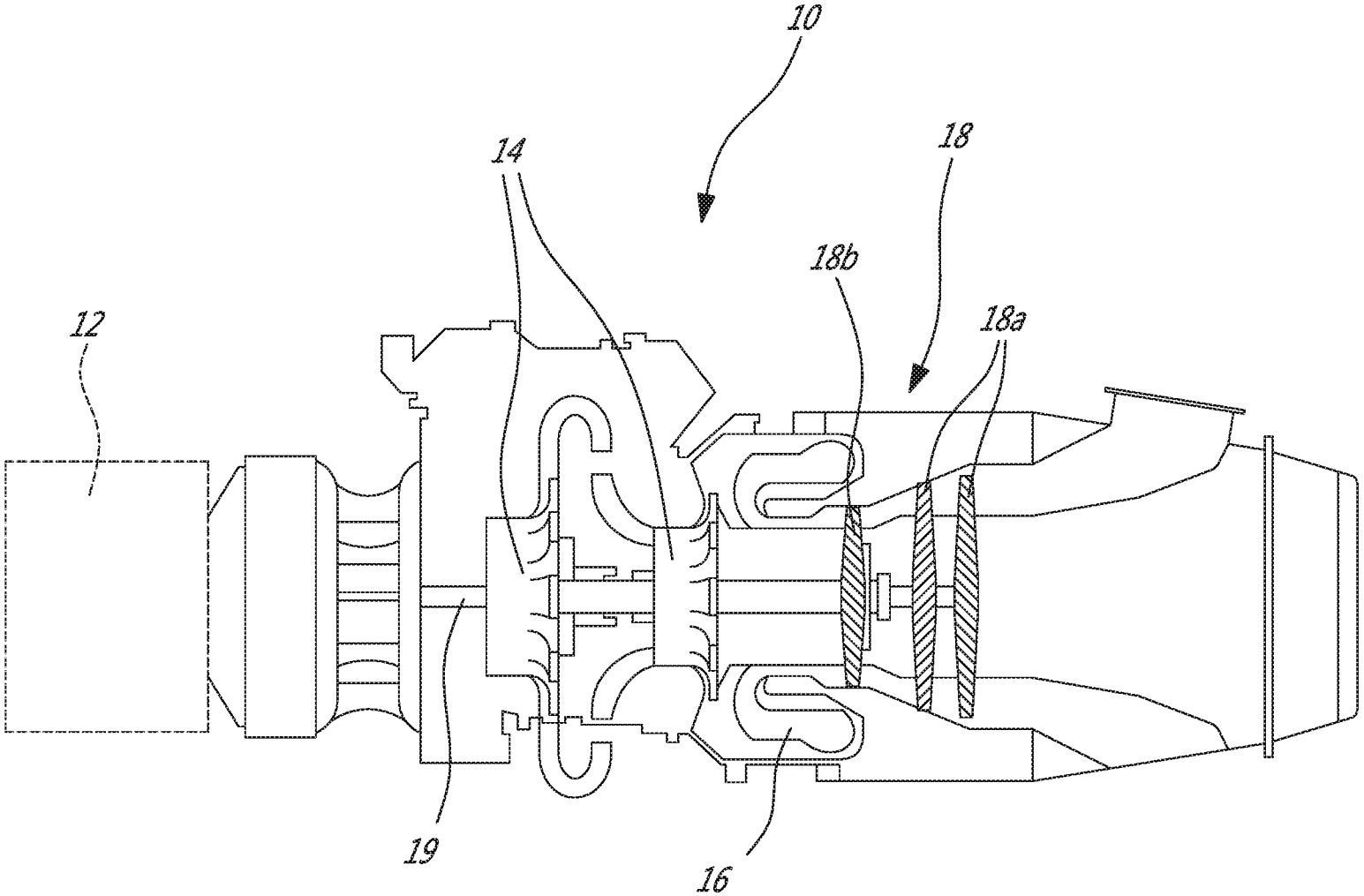
FIG. 1 is a schematic view of a turboshaft gas turbine engine.

FIG. 1 illustrates a turboshaft engine 10 of a type preferably provided for use in subsonic flight, generally comprising in serial flow communication a compressor 14 for pressurizing the air, a combustor 16 in which the compressed air is mixed with fuel and ignited for generating an annular stream of hot combustion gases, and a turbine section 18 for extracting energy from the combustion gases. The turbine section 18 comprises a single-stage compressor turbine 18*b* and a multi-stage power turbine 18*a*. The compressor turbine 18*b* drives the compressor 14, whereas the power turbine drives the output shaft 12.

Figure 2:
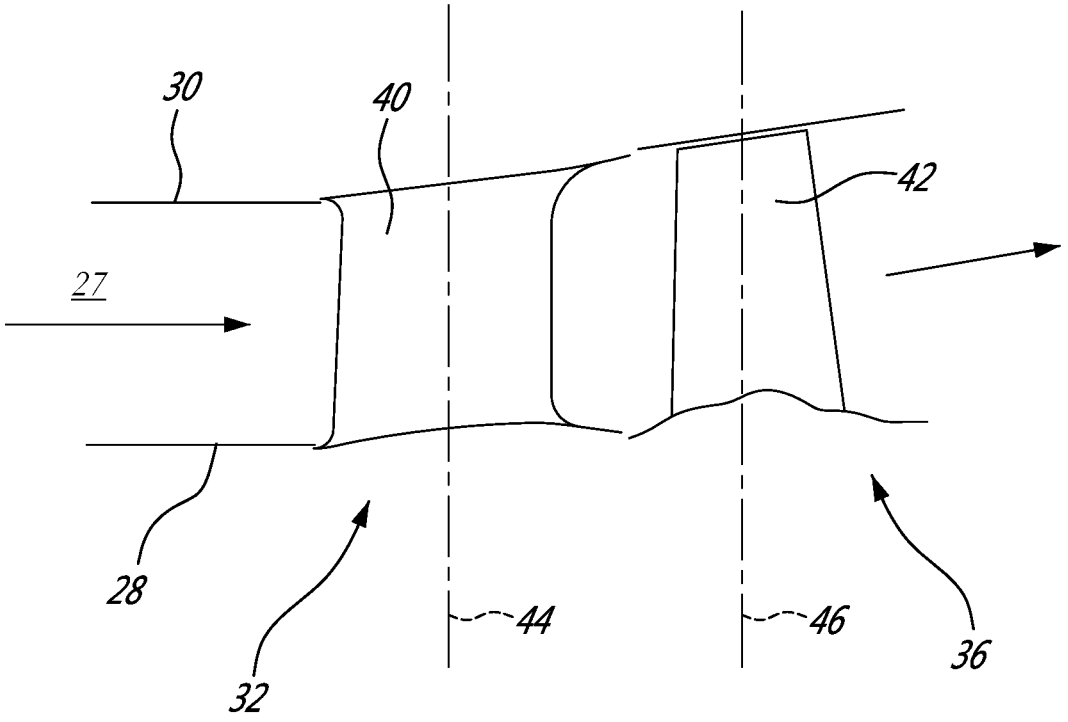
FIG. 2 is a schematic view of a compressor turbine portion of a gaspath of a gas turbine engine, including a compressor turbine.
Figure 2:
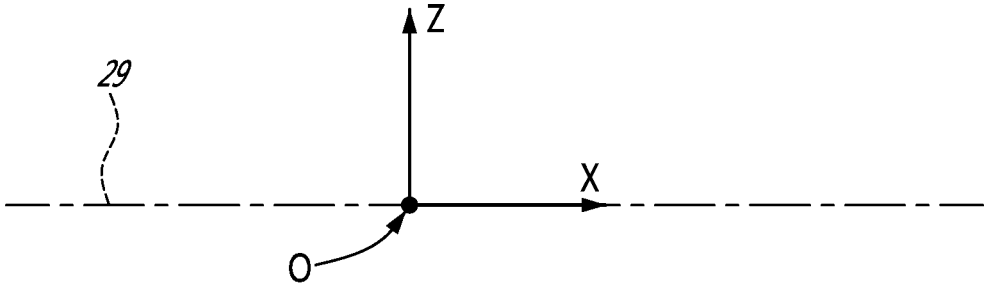

FIG. 2 illustrates a portion of an annular hot gaspath, indicated by arrows 27 and defined by annular inner and outer walls 28 and 30 respectively, for directing the stream of hot combustion gases axially in an annular flow. The profile of the inner and outer walls 28 and 30 of the annular gaspath, "cold" (i.e. non-operating) conditions, is defined by the Cartesian coordinate values such as the ones given in Table 1 below. More particularly, the inner and outer gaspath walls 28 and 30 are defined with respect to mutually orthogonal x and z axes, as shown in FIG. 2. The x axis corresponds to the engine turbine rotor centerline 29. The radial distance of the inner and outer walls 28 and 30 from the engine turbine rotor centerline and, thus, from the x-axis at specific axial locations is measured along the z axis. The z values provide the inner and outer radius of the gaspath at various axial locations therealong. The x and z coordinate values in Table 1 are distances given in inches from the point of origin O (see FIG. 2). It is understood that other units of dimensions may be used. The x and z values have in average a manufacturing tolerance of about ±0.030". The tolerance may account for such things as casting, coating, ceramic coating and/or other tolerances. It is understood that the manufacturing tolerances of the gas path may vary along the length thereof.

The compressor turbine 18*b* has a single high pressure turbine (HPT) stage located in the gaspath 27 downstream of the combustor 16. Referring to FIG. 2, the compressor turbine 18*b* comprises a stator assembly 32 and a rotor assembly 36 having a plurality of circumferentially arranged vanes 40 and blades 42, respectively. The vanes 40 and blades 42 are mounted in position along respective stacking lines 44 and 46, as identified in FIG. 2. The stacking lines 44 and 46 extend in the radial direction along the z axis at different axial locations. The stacking lines 44 and 46 define the axial location where the compressor turbine vanes and blades are mounted in the engine 10.

Table 1 provides cold coated inner diameter and cold uncoated outer diameter axi-symmetric gaspath definition from upstream to downstream of the compressor turbine blade airfoil 42.

TABLE 1

| COLD COATED GASPATH DEFINITION | | | |
|---|---|---|---|
| INNER DIAMETER GASPATH | | OUTER DIAMETER GASPATH | |
| X | Z | X | Z |
| 0.422 | 3.659 | 0.422 | 4.802 |
| 0.400 | 3.657 | 0.400 | 4.802 |
| 0.300 | 3.648 | 0.300 | 4.802 |
| 0.200 | 3.638 | 0.200 | 4.802 |
| 0.100 | 3.627 | 0.100 | 4.802 |
| 0.000 | 3.613 | 0.000 | 4.802 |
| −0.100 | 3.598 | −0.100 | 4.802 |
| −0.200 | 3.580 | −0.200 | 4.802 |
| −0.300 | 3.562 | −0.300 | 4.802 |
| −0.400 | 3.551 | −0.400 | 4.802 |
| −0.500 | 3.545 | −0.500 | 4.802 |
| −0.600 | 3.541 | −0.600 | 4.802 |
| −0.700 | 3.538 | −0.700 | 4.802 |
| −0.730 | 3.537 | −0.730 | 4.802 |

Figure 3:
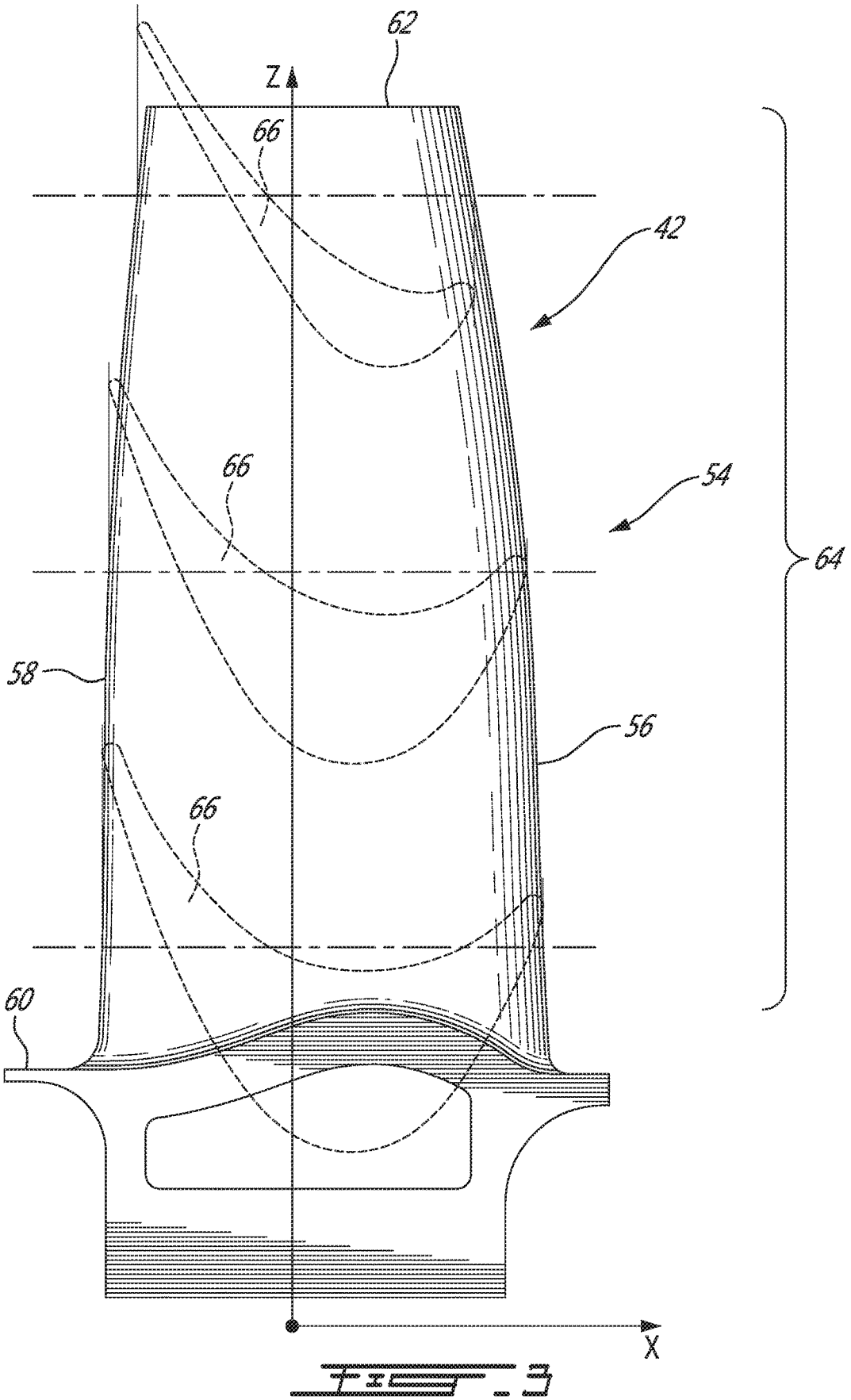
FIG. 3 is a schematic elevation view of a compressor turbine blade having a blade profile defined in accordance with an embodiment of the present application.

More specifically, the rotor assembly 36 has a plurality of circumferentially distributed blades 42 which extend radially across the hot gaspath 27. FIG. 3 shows an example of one of the blades 42 of the compressor turbine stage. It can be seen that each blade 42 has an airfoil 54 having a leading edge 56 and a trailing edge 58, extending from an inner platform 60 to a tip 62.

The novel airfoil shape of each compressor turbine blade 42 is defined by a set of X-Y-Z points in space. This set of points represents a novel and unique solution to the target design criteria discussed above, and are well-adapted for use in a single-stage compressor turbine. The set of points are defined in a Cartesian coordinate system which has mutually orthogonal X, Y and Z axes. The X axis extends axially along the turbine rotor centerline 29, i.e., the rotary axis. In the illustrated embodiment, the positive X direction is axially towards the aft of the turbine engine 10. The Z axis extends along the compressor turbine blade stacking line 46 of each respective blade 42 in a generally radial direction and intersects the X axis. The positive Z direction is radially outwardly toward the tip 62 of the blade. The Y axis extends tangentially with the positive Y direction being in the direction of rotation of the rotor assembly 36. Therefore, the origin of the X, Y and Z axes is defined at the point of intersection of all three orthogonally-related axes: that is the point (0,0,0) at the intersection of the center of rotation of the turbine engine 10 and the stacking line 46.

In a particular embodiment of the compressor turbine blade, the set of points which define the blade airfoil profile relative to the axis of rotation of the turbine engine 10 and stacking line 46 thereof are set out in Table 2 below as X, Y and Z Cartesian coordinate values. Particularly, the blade airfoil profile is defined by profile sections 66 at various locations along its height, the locations represented by Z values. For example, if the blades 42 are mounted about the rotor assembly 36 at an angle with respect to the radial direction, then the Z values are not a true representation of the height of the airfoils of the blades 42. Furthermore, it is to be appreciated that, with respect to Table 2, Z values are not actually radial heights, per se, from the centerline but rather a height from a plane through the centerline—i.e. the sections in Table 2 are planar. The coordinate values are set forth in inches in Table 2 although other units of dimensions may be used when the values are appropriately converted.

Thus, at each Z distance, the X and Y coordinate values of the desired profile section 66 are defined at selected locations in a Z direction normal to the X, Y plane. The X and Y coordinates are given in distance dimensions, e.g., units of inches, and are joined smoothly, using appropriate curve-fitting techniques, at each Z location to form a smooth continuous airfoil cross-section. The blade airfoil profiles of the various surface locations between the distances Z are determined by smoothly connecting the adjacent profile sections 66 to one another to form the airfoil profile.

The coordinate values listed in Table 2 below represent the desired airfoil profiles in a "cold" non-operating coated condition (and at nominal restagger). However, the manufactured airfoil surface profile will be slightly different, as a result of manufacturing and applied coating tolerances. According to an embodiment of the present invention, the finished compressor turbine blade is coated with a thermal protecting layer.

The Table 2 values are generated and shown to three decimal places for determining the profile of the compressor turbine blade airfoil. However, as mentioned above, there are manufacturing tolerance issues to be addressed and, accordingly, the values for the profile given in Table 2 are for a theoretical airfoil. A profile tolerance of ±0.030 inches, measured perpendicularly to the airfoil surface is additive to the nominal values given in Table 2 below. The profile tolerance accounts for airfoil profile casting, coating and ceramic coating tolerances. The coating typically applied on the blades defined in Table 2 is about 0.0010 inches to 0.0020 inches thick. According to one embodiment, the compressor turbine blade has a constant coating of 0.0015 inches. The cold or room temperature profile is given by the X, Y and Z coordinates for manufacturing purposes. It is understood that the airfoil may deform, within acceptable limits, once entering service.

The coordinate values given in Table 2 below provide the preferred cold coated (at nominal restagger) blade airfoil profile.

TABLE 2

| X | Y | Z |
|---|---|---|
| SECTION 1 | | |
| 0.418 | 0.136 | 3.471 |
| 0.417 | 0.132 | 3.471 |
| 0.417 | 0.129 | 3.471 |
| 0.416 | 0.126 | 3.471 |
| 0.415 | 0.123 | 3.471 |
| 0.414 | 0.120 | 3.471 |
| 0.413 | 0.116 | 3.471 |
| 0.412 | 0.113 | 3.471 |
| 0.411 | 0.110 | 3.471 |
| 0.410 | 0.107 | 3.471 |
| 0.409 | 0.104 | 3.471 |

TABLE 2-continued

| X | Y | Z |
|---|---|---|
| 0.402 | 0.088 | 3.471 |
| 0.395 | 0.074 | 3.471 |
| 0.387 | 0.059 | 3.471 |
| 0.379 | 0.045 | 3.471 |
| 0.370 | 0.031 | 3.471 |
| 0.361 | 0.017 | 3.471 |
| 0.351 | 0.003 | 3.471 |
| 0.341 | −0.011 | 3.471 |
| 0.331 | −0.024 | 3.471 |
| 0.321 | −0.037 | 3.471 |
| 0.311 | −0.050 | 3.471 |
| 0.300 | −0.063 | 3.471 |
| 0.289 | −0.075 | 3.471 |
| 0.277 | −0.087 | 3.471 |
| 0.265 | −0.099 | 3.471 |
| 0.253 | −0.110 | 3.471 |
| 0.240 | −0.121 | 3.471 |
| 0.227 | −0.131 | 3.471 |
| 0.214 | −0.141 | 3.471 |
| 0.200 | −0.150 | 3.471 |
| 0.185 | −0.158 | 3.471 |
| 0.171 | −0.166 | 3.471 |
| 0.156 | −0.173 | 3.471 |
| 0.140 | −0.180 | 3.471 |
| 0.125 | −0.185 | 3.471 |
| 0.109 | −0.190 | 3.471 |
| 0.093 | −0.195 | 3.471 |
| 0.077 | −0.198 | 3.471 |
| 0.060 | −0.201 | 3.471 |
| 0.044 | −0.203 | 3.471 |
| 0.027 | −0.204 | 3.471 |
| 0.010 | −0.204 | 3.471 |
| −0.006 | −0.203 | 3.471 |
| −0.023 | −0.201 | 3.471 |
| −0.039 | −0.198 | 3.471 |
| −0.055 | −0.195 | 3.471 |
| −0.071 | −0.190 | 3.471 |
| −0.087 | −0.184 | 3.471 |
| −0.103 | −0.178 | 3.471 |
| −0.118 | −0.171 | 3.471 |
| −0.132 | −0.163 | 3.471 |
| −0.147 | −0.155 | 3.471 |
| −0.161 | −0.146 | 3.471 |
| −0.174 | −0.136 | 3.471 |
| −0.188 | −0.126 | 3.471 |
| −0.200 | −0.116 | 3.471 |
| −0.213 | −0.105 | 3.471 |
| −0.225 | −0.093 | 3.471 |
| −0.237 | −0.082 | 3.471 |
| −0.249 | −0.070 | 3.471 |
| −0.260 | −0.057 | 3.471 |
| −0.271 | −0.045 | 3.471 |
| −0.281 | −0.032 | 3.471 |
| −0.292 | −0.019 | 3.471 |
| −0.301 | −0.005 | 3.471 |
| −0.311 | 0.008 | 3.471 |
| −0.320 | 0.022 | 3.471 |
| −0.330 | 0.036 | 3.471 |
| −0.338 | 0.050 | 3.471 |
| −0.347 | 0.064 | 3.471 |
| −0.355 | 0.079 | 3.471 |
| −0.363 | 0.093 | 3.471 |
| −0.371 | 0.108 | 3.471 |
| −0.379 | 0.123 | 3.471 |
| −0.386 | 0.137 | 3.471 |
| −0.394 | 0.152 | 3.471 |
| −0.401 | 0.167 | 3.471 |
| −0.408 | 0.182 | 3.471 |
| −0.415 | 0.198 | 3.471 |
| −0.422 | 0.213 | 3.471 |
| −0.429 | 0.228 | 3.471 |
| −0.435 | 0.243 | 3.471 |
| −0.442 | 0.259 | 3.471 |
| −0.448 | 0.274 | 3.471 |
| −0.455 | 0.289 | 3.471 |
| −0.461 | 0.305 | 3.471 |
| −0.467 | 0.320 | 3.471 |
| −0.473 | 0.336 | 3.471 |

TABLE 2-continued

| X | Y | Z |
|---|---|---|
| −0.479 | 0.351 | 3.471 |
| −0.480 | 0.354 | 3.471 |
| −0.481 | 0.357 | 3.471 |
| −0.482 | 0.361 | 3.471 |
| −0.483 | 0.364 | 3.471 |
| −0.485 | 0.367 | 3.471 |
| −0.486 | 0.370 | 3.471 |
| −0.487 | 0.373 | 3.471 |
| −0.488 | 0.376 | 3.471 |
| −0.489 | 0.379 | 3.471 |
| −0.490 | 0.383 | 3.471 |
| −0.491 | 0.384 | 3.471 |
| −0.491 | 0.386 | 3.471 |
| −0.491 | 0.388 | 3.471 |
| −0.490 | 0.390 | 3.471 |
| −0.490 | 0.392 | 3.471 |
| −0.489 | 0.394 | 3.471 |
| −0.487 | 0.395 | 3.471 |
| −0.486 | 0.397 | 3.471 |
| −0.484 | 0.398 | 3.471 |
| −0.483 | 0.399 | 3.471 |
| −0.481 | 0.399 | 3.471 |
| −0.479 | 0.400 | 3.471 |
| −0.477 | 0.400 | 3.471 |
| −0.475 | 0.399 | 3.471 |
| −0.473 | 0.399 | 3.471 |
| −0.471 | 0.398 | 3.471 |
| −0.470 | 0.396 | 3.471 |
| −0.469 | 0.395 | 3.471 |
| −0.468 | 0.393 | 3.471 |
| −0.467 | 0.391 | 3.471 |
| −0.466 | 0.389 | 3.471 |
| −0.464 | 0.387 | 3.471 |
| −0.463 | 0.384 | 3.471 |
| −0.462 | 0.382 | 3.471 |
| −0.461 | 0.380 | 3.471 |
| −0.460 | 0.378 | 3.471 |
| −0.459 | 0.376 | 3.471 |
| −0.458 | 0.373 | 3.471 |
| −0.457 | 0.371 | 3.471 |
| −0.451 | 0.361 | 3.471 |
| −0.445 | 0.350 | 3.471 |
| −0.438 | 0.339 | 3.471 |
| −0.432 | 0.329 | 3.471 |
| −0.425 | 0.319 | 3.471 |
| −0.418 | 0.309 | 3.471 |
| −0.411 | 0.299 | 3.471 |
| −0.404 | 0.289 | 3.471 |
| −0.397 | 0.279 | 3.471 |
| −0.390 | 0.269 | 3.471 |
| −0.382 | 0.259 | 3.471 |
| −0.375 | 0.250 | 3.471 |
| −0.367 | 0.240 | 3.471 |
| −0.359 | 0.231 | 3.471 |
| −0.351 | 0.221 | 3.471 |
| −0.343 | 0.212 | 3.471 |
| −0.335 | 0.203 | 3.471 |
| −0.326 | 0.195 | 3.471 |
| −0.318 | 0.186 | 3.471 |
| −0.309 | 0.177 | 3.471 |
| −0.300 | 0.169 | 3.471 |
| −0.291 | 0.161 | 3.471 |
| −0.281 | 0.153 | 3.471 |
| −0.272 | 0.146 | 3.471 |
| −0.262 | 0.138 | 3.471 |
| −0.252 | 0.131 | 3.471 |
| −0.242 | 0.124 | 3.471 |
| −0.231 | 0.118 | 3.471 |
| −0.221 | 0.111 | 3.471 |
| −0.210 | 0.105 | 3.471 |
| −0.199 | 0.099 | 3.471 |
| −0.189 | 0.094 | 3.471 |
| −0.177 | 0.089 | 3.471 |
| −0.166 | 0.084 | 3.471 |
| −0.155 | 0.079 | 3.471 |
| −0.144 | 0.074 | 3.471 |
| −0.132 | 0.070 | 3.471 |
| −0.121 | 0.066 | 3.471 |

TABLE 2-continued

| X | Y | Z |
|---|---|---|
| −0.109 | 0.062 | 3.471 |
| −0.097 | 0.059 | 3.471 |
| −0.085 | 0.056 | 3.471 |
| −0.074 | 0.053 | 3.471 |
| −0.062 | 0.050 | 3.471 |
| −0.050 | 0.048 | 3.471 |
| −0.038 | 0.045 | 3.471 |
| −0.025 | 0.044 | 3.471 |
| −0.013 | 0.042 | 3.471 |
| −0.001 | 0.041 | 3.471 |
| 0.011 | 0.040 | 3.471 |
| 0.023 | 0.040 | 3.471 |
| 0.036 | 0.040 | 3.471 |
| 0.048 | 0.040 | 3.471 |
| 0.060 | 0.040 | 3.471 |
| 0.072 | 0.041 | 3.471 |
| 0.084 | 0.043 | 3.471 |
| 0.097 | 0.045 | 3.471 |
| 0.109 | 0.047 | 3.471 |
| 0.121 | 0.049 | 3.471 |
| 0.133 | 0.051 | 3.471 |
| 0.144 | 0.054 | 3.471 |
| 0.156 | 0.058 | 3.471 |
| 0.168 | 0.061 | 3.471 |
| 0.180 | 0.065 | 3.471 |
| 0.191 | 0.068 | 3.471 |
| 0.203 | 0.072 | 3.471 |
| 0.214 | 0.077 | 3.471 |
| 0.226 | 0.081 | 3.471 |
| 0.237 | 0.086 | 3.471 |
| 0.249 | 0.090 | 3.471 |
| 0.260 | 0.095 | 3.471 |
| 0.271 | 0.100 | 3.471 |
| 0.282 | 0.106 | 3.471 |
| 0.293 | 0.111 | 3.471 |
| 0.304 | 0.117 | 3.471 |
| 0.315 | 0.122 | 3.471 |
| 0.325 | 0.128 | 3.471 |
| 0.336 | 0.134 | 3.471 |
| 0.346 | 0.141 | 3.471 |
| 0.357 | 0.148 | 3.471 |
| 0.359 | 0.149 | 3.471 |
| 0.361 | 0.150 | 3.471 |
| 0.363 | 0.152 | 3.471 |
| 0.365 | 0.153 | 3.471 |
| 0.367 | 0.154 | 3.471 |
| 0.369 | 0.156 | 3.471 |
| 0.371 | 0.157 | 3.471 |
| 0.373 | 0.159 | 3.471 |
| 0.375 | 0.160 | 3.471 |
| 0.377 | 0.162 | 3.471 |
| 0.380 | 0.164 | 3.471 |
| 0.383 | 0.166 | 3.471 |
| 0.386 | 0.167 | 3.471 |
| 0.389 | 0.168 | 3.471 |
| 0.393 | 0.169 | 3.471 |
| 0.397 | 0.170 | 3.471 |
| 0.400 | 0.170 | 3.471 |
| 0.404 | 0.169 | 3.471 |
| 0.407 | 0.168 | 3.471 |
| 0.410 | 0.166 | 3.471 |
| 0.413 | 0.164 | 3.471 |
| 0.415 | 0.161 | 3.471 |
| 0.417 | 0.157 | 3.471 |
| 0.418 | 0.154 | 3.471 |
| 0.419 | 0.150 | 3.471 |
| 0.419 | 0.147 | 3.471 |
| 0.419 | 0.143 | 3.471 |
| 0.419 | 0.139 | 3.471 |
| | SECTION 2 | |
| 0.375 | 0.118 | 3.781 |
| 0.374 | 0.115 | 3.781 |
| 0.374 | 0.112 | 3.781 |
| 0.373 | 0.109 | 3.781 |
| 0.372 | 0.106 | 3.781 |
| 0.371 | 0.103 | 3.781 |
| 0.371 | 0.100 | 3.781 |

TABLE 2-continued

| X | Y | Z |
|---|---|---|
| 0.370 | 0.097 | 3.781 |
| 0.369 | 0.094 | 3.781 |
| 0.368 | 0.091 | 3.781 |
| 0.367 | 0.088 | 3.781 |
| 0.361 | 0.073 | 3.781 |
| 0.355 | 0.059 | 3.781 |
| 0.349 | 0.045 | 3.781 |
| 0.342 | 0.031 | 3.781 |
| 0.335 | 0.018 | 3.781 |
| 0.327 | 0.004 | 3.781 |
| 0.319 | −0.009 | 3.781 |
| 0.310 | −0.022 | 3.781 |
| 0.301 | −0.034 | 3.781 |
| 0.292 | −0.047 | 3.781 |
| 0.282 | −0.059 | 3.781 |
| 0.272 | −0.070 | 3.781 |
| 0.262 | −0.082 | 3.781 |
| 0.251 | −0.093 | 3.781 |
| 0.239 | −0.103 | 3.781 |
| 0.228 | −0.113 | 3.781 |
| 0.215 | −0.123 | 3.781 |
| 0.203 | −0.132 | 3.781 |
| 0.190 | −0.140 | 3.781 |
| 0.177 | −0.148 | 3.781 |
| 0.163 | −0.156 | 3.781 |
| 0.149 | −0.162 | 3.781 |
| 0.135 | −0.169 | 3.781 |
| 0.121 | −0.174 | 3.781 |
| 0.106 | −0.180 | 3.781 |
| 0.091 | −0.184 | 3.781 |
| 0.076 | −0.188 | 3.781 |
| 0.061 | −0.191 | 3.781 |
| 0.046 | −0.194 | 3.781 |
| 0.031 | −0.196 | 3.781 |
| 0.015 | −0.197 | 3.781 |
| 0.000 | −0.197 | 3.781 |
| −0.016 | −0.196 | 3.781 |
| −0.031 | −0.194 | 3.781 |
| −0.046 | −0.191 | 3.781 |
| −0.061 | −0.187 | 3.781 |
| −0.076 | −0.182 | 3.781 |
| −0.090 | −0.177 | 3.781 |
| −0.104 | −0.170 | 3.781 |
| −0.118 | −0.163 | 3.781 |
| −0.131 | −0.155 | 3.781 |
| −0.144 | −0.146 | 3.781 |
| −0.157 | −0.137 | 3.781 |
| −0.169 | −0.128 | 3.781 |
| −0.181 | −0.118 | 3.781 |
| −0.192 | −0.107 | 3.781 |
| −0.203 | −0.096 | 3.781 |
| −0.214 | −0.085 | 3.781 |
| −0.224 | −0.073 | 3.781 |
| −0.234 | −0.062 | 3.781 |
| −0.244 | −0.050 | 3.781 |
| −0.253 | −0.037 | 3.781 |
| −0.262 | −0.025 | 3.781 |
| −0.271 | −0.012 | 3.781 |
| −0.280 | 0.001 | 3.781 |
| −0.288 | 0.014 | 3.781 |
| −0.296 | 0.027 | 3.781 |
| −0.304 | 0.040 | 3.781 |
| −0.312 | 0.053 | 3.781 |
| −0.320 | 0.067 | 3.781 |
| −0.327 | 0.080 | 3.781 |
| −0.335 | 0.094 | 3.781 |
| −0.342 | 0.108 | 3.781 |
| −0.349 | 0.121 | 3.781 |
| −0.356 | 0.135 | 3.781 |
| −0.363 | 0.149 | 3.781 |
| −0.369 | 0.163 | 3.781 |
| −0.376 | 0.177 | 3.781 |
| −0.383 | 0.191 | 3.781 |
| −0.389 | 0.205 | 3.781 |
| −0.395 | 0.219 | 3.781 |
| −0.402 | 0.233 | 3.781 |
| −0.408 | 0.248 | 3.781 |
| −0.414 | 0.262 | 3.781 |

TABLE 2-continued

| X | Y | Z |
|---|---|---|
| −0.420 | 0.276 | 3.781 |
| −0.425 | 0.290 | 3.781 |
| −0.431 | 0.305 | 3.781 |
| −0.437 | 0.319 | 3.781 |
| −0.442 | 0.334 | 3.781 |
| −0.443 | 0.337 | 3.781 |
| −0.444 | 0.340 | 3.781 |
| −0.445 | 0.343 | 3.781 |
| −0.446 | 0.346 | 3.781 |
| −0.447 | 0.348 | 3.781 |
| −0.448 | 0.351 | 3.781 |
| −0.449 | 0.354 | 3.781 |
| −0.450 | 0.357 | 3.781 |
| −0.451 | 0.360 | 3.781 |
| −0.452 | 0.363 | 3.781 |
| −0.453 | 0.365 | 3.781 |
| −0.453 | 0.367 | 3.781 |
| −0.453 | 0.368 | 3.781 |
| −0.452 | 0.370 | 3.781 |
| −0.452 | 0.372 | 3.781 |
| −0.451 | 0.373 | 3.781 |
| −0.450 | 0.375 | 3.781 |
| −0.448 | 0.376 | 3.781 |
| −0.447 | 0.377 | 3.781 |
| −0.445 | 0.378 | 3.781 |
| −0.444 | 0.378 | 3.781 |
| −0.442 | 0.379 | 3.781 |
| −0.440 | 0.379 | 3.781 |
| −0.438 | 0.378 | 3.781 |
| −0.437 | 0.378 | 3.781 |
| −0.435 | 0.377 | 3.781 |
| −0.434 | 0.376 | 3.781 |
| −0.433 | 0.374 | 3.781 |
| −0.432 | 0.373 | 3.781 |
| −0.431 | 0.371 | 3.781 |
| −0.430 | 0.369 | 3.781 |
| −0.429 | 0.367 | 3.781 |
| −0.428 | 0.365 | 3.781 |
| −0.427 | 0.362 | 3.781 |
| −0.426 | 0.360 | 3.781 |
| −0.425 | 0.358 | 3.781 |
| −0.424 | 0.356 | 3.781 |
| −0.423 | 0.354 | 3.781 |
| −0.422 | 0.353 | 3.781 |
| −0.417 | 0.343 | 3.781 |
| −0.412 | 0.333 | 3.781 |
| −0.406 | 0.323 | 3.781 |
| −0.401 | 0.313 | 3.781 |
| −0.395 | 0.304 | 3.781 |
| −0.389 | 0.294 | 3.781 |
| −0.383 | 0.285 | 3.781 |
| −0.377 | 0.276 | 3.781 |
| −0.370 | 0.267 | 3.781 |
| −0.364 | 0.258 | 3.781 |
| −0.357 | 0.249 | 3.781 |
| −0.350 | 0.240 | 3.781 |
| −0.343 | 0.231 | 3.781 |
| −0.336 | 0.223 | 3.781 |
| −0.329 | 0.214 | 3.781 |
| −0.321 | 0.206 | 3.781 |
| −0.314 | 0.198 | 3.781 |
| −0.306 | 0.190 | 3.781 |
| −0.298 | 0.183 | 3.781 |
| −0.290 | 0.175 | 3.781 |
| −0.281 | 0.168 | 3.781 |
| −0.273 | 0.160 | 3.781 |
| −0.264 | 0.153 | 3.781 |
| −0.255 | 0.147 | 3.781 |
| −0.246 | 0.140 | 3.781 |
| −0.237 | 0.134 | 3.781 |
| −0.228 | 0.128 | 3.781 |
| −0.218 | 0.122 | 3.781 |
| −0.209 | 0.116 | 3.781 |
| −0.199 | 0.110 | 3.781 |
| −0.189 | 0.105 | 3.781 |
| −0.179 | 0.100 | 3.781 |
| −0.169 | 0.095 | 3.781 |
| −0.159 | 0.090 | 3.781 |

TABLE 2-continued

| X | Y | Z |
|---|---|---|
| −0.149 | 0.086 | 3.781 |
| −0.139 | 0.081 | 3.781 |
| −0.129 | 0.077 | 3.781 |
| −0.118 | 0.073 | 3.781 |
| −0.108 | 0.070 | 3.781 |
| −0.097 | 0.066 | 3.781 |
| −0.086 | 0.063 | 3.781 |
| −0.076 | 0.060 | 3.781 |
| −0.065 | 0.057 | 3.781 |
| −0.054 | 0.054 | 3.781 |
| −0.043 | 0.052 | 3.781 |
| −0.032 | 0.050 | 3.781 |
| −0.021 | 0.048 | 3.781 |
| −0.010 | 0.047 | 3.781 |
| 0.001 | 0.045 | 3.781 |
| 0.012 | 0.044 | 3.781 |
| 0.023 | 0.043 | 3.781 |
| 0.034 | 0.043 | 3.781 |
| 0.045 | 0.043 | 3.781 |
| 0.057 | 0.043 | 3.781 |
| 0.068 | 0.043 | 3.781 |
| 0.079 | 0.044 | 3.781 |
| 0.090 | 0.045 | 3.781 |
| 0.101 | 0.047 | 3.781 |
| 0.112 | 0.048 | 3.781 |
| 0.123 | 0.050 | 3.781 |
| 0.134 | 0.053 | 3.781 |
| 0.145 | 0.055 | 3.781 |
| 0.155 | 0.058 | 3.781 |
| 0.166 | 0.061 | 3.781 |
| 0.177 | 0.065 | 3.781 |
| 0.187 | 0.068 | 3.781 |
| 0.198 | 0.072 | 3.781 |
| 0.208 | 0.076 | 3.781 |
| 0.218 | 0.080 | 3.781 |
| 0.229 | 0.084 | 3.781 |
| 0.239 | 0.089 | 3.781 |
| 0.249 | 0.094 | 3.781 |
| 0.259 | 0.099 | 3.781 |
| 0.269 | 0.104 | 3.781 |
| 0.279 | 0.109 | 3.781 |
| 0.288 | 0.115 | 3.781 |
| 0.298 | 0.120 | 3.781 |
| 0.307 | 0.126 | 3.781 |
| 0.317 | 0.132 | 3.781 |
| 0.319 | 0.133 | 3.781 |
| 0.321 | 0.135 | 3.781 |
| 0.322 | 0.136 | 3.781 |
| 0.324 | 0.137 | 3.781 |
| 0.326 | 0.138 | 3.781 |
| 0.328 | 0.140 | 3.781 |
| 0.330 | 0.141 | 3.781 |
| 0.332 | 0.142 | 3.781 |
| 0.333 | 0.143 | 3.781 |
| 0.335 | 0.145 | 3.781 |
| 0.338 | 0.147 | 3.781 |
| 0.341 | 0.148 | 3.781 |
| 0.345 | 0.150 | 3.781 |
| 0.348 | 0.151 | 3.781 |
| 0.351 | 0.152 | 3.781 |
| 0.355 | 0.152 | 3.781 |
| 0.359 | 0.152 | 3.781 |
| 0.362 | 0.151 | 3.781 |
| 0.365 | 0.150 | 3.781 |
| 0.368 | 0.148 | 3.781 |
| 0.371 | 0.145 | 3.781 |
| 0.373 | 0.142 | 3.781 |
| 0.374 | 0.139 | 3.781 |
| 0.375 | 0.136 | 3.781 |
| 0.376 | 0.132 | 3.781 |
| 0.376 | 0.128 | 3.781 |
| 0.376 | 0.125 | 3.781 |
| 0.376 | 0.121 | 3.781 |
| SECTION 3 | | |
| 0.356 | 0.106 | 3.921 |
| 0.355 | 0.103 | 3.921 |
| 0.355 | 0.100 | 3.921 |

TABLE 2-continued

| X | Y | Z |
|---|---|---|
| 0.354 | 0.097 | 3.921 |
| 0.353 | 0.094 | 3.921 |
| 0.352 | 0.092 | 3.921 |
| 0.352 | 0.089 | 3.921 |
| 0.351 | 0.086 | 3.921 |
| 0.350 | 0.083 | 3.921 |
| 0.349 | 0.080 | 3.921 |
| 0.348 | 0.077 | 3.921 |
| 0.343 | 0.063 | 3.921 |
| 0.338 | 0.049 | 3.921 |
| 0.332 | 0.036 | 3.921 |
| 0.325 | 0.022 | 3.921 |
| 0.319 | 0.009 | 3.921 |
| 0.312 | −0.004 | 3.921 |
| 0.304 | −0.017 | 3.921 |
| 0.296 | −0.030 | 3.921 |
| 0.288 | −0.042 | 3.921 |
| 0.279 | −0.054 | 3.921 |
| 0.270 | −0.066 | 3.921 |
| 0.260 | −0.077 | 3.921 |
| 0.250 | −0.088 | 3.921 |
| 0.239 | −0.099 | 3.921 |
| 0.228 | −0.109 | 3.921 |
| 0.217 | −0.118 | 3.921 |
| 0.205 | −0.127 | 3.921 |
| 0.193 | −0.136 | 3.921 |
| 0.180 | −0.144 | 3.921 |
| 0.168 | −0.152 | 3.921 |
| 0.154 | −0.159 | 3.921 |
| 0.141 | −0.165 | 3.921 |
| 0.127 | −0.171 | 3.921 |
| 0.113 | −0.177 | 3.921 |
| 0.099 | −0.181 | 3.921 |
| 0.085 | −0.186 | 3.921 |
| 0.071 | −0.189 | 3.921 |
| 0.056 | −0.192 | 3.921 |
| 0.041 | −0.195 | 3.921 |
| 0.026 | −0.196 | 3.921 |
| 0.011 | −0.197 | 3.921 |
| −0.003 | −0.196 | 3.921 |
| −0.018 | −0.195 | 3.921 |
| −0.033 | −0.193 | 3.921 |
| −0.048 | −0.190 | 3.921 |
| −0.062 | −0.186 | 3.921 |
| −0.076 | −0.181 | 3.921 |
| −0.090 | −0.175 | 3.921 |
| −0.103 | −0.169 | 3.921 |
| −0.116 | −0.161 | 3.921 |
| −0.129 | −0.153 | 3.921 |
| −0.141 | −0.145 | 3.921 |
| −0.153 | −0.136 | 3.921 |
| −0.164 | −0.126 | 3.921 |
| −0.175 | −0.116 | 3.921 |
| −0.186 | −0.106 | 3.921 |
| −0.196 | −0.095 | 3.921 |
| −0.206 | −0.083 | 3.921 |
| −0.215 | −0.072 | 3.921 |
| −0.224 | −0.060 | 3.921 |
| −0.233 | −0.048 | 3.921 |
| −0.242 | −0.036 | 3.921 |
| −0.250 | −0.024 | 3.921 |
| −0.258 | −0.011 | 3.921 |
| −0.266 | 0.002 | 3.921 |
| −0.274 | 0.014 | 3.921 |
| −0.282 | 0.027 | 3.921 |
| −0.289 | 0.040 | 3.921 |
| −0.296 | 0.053 | 3.921 |
| −0.304 | 0.066 | 3.921 |
| −0.311 | 0.079 | 3.921 |
| −0.318 | 0.092 | 3.921 |
| −0.324 | 0.106 | 3.921 |
| −0.331 | 0.119 | 3.921 |
| −0.338 | 0.132 | 3.921 |
| −0.344 | 0.146 | 3.921 |
| −0.351 | 0.159 | 3.921 |
| −0.357 | 0.173 | 3.921 |
| −0.364 | 0.186 | 3.921 |
| −0.370 | 0.200 | 3.921 |

TABLE 2-continued

| X | Y | Z |
|---|---|---|
| −0.376 | 0.213 | 3.921 |
| −0.382 | 0.227 | 3.921 |
| −0.388 | 0.241 | 3.921 |
| −0.394 | 0.254 | 3.921 |
| −0.399 | 0.268 | 3.921 |
| −0.405 | 0.282 | 3.921 |
| −0.411 | 0.296 | 3.921 |
| −0.416 | 0.310 | 3.921 |
| −0.421 | 0.324 | 3.921 |
| −0.422 | 0.326 | 3.921 |
| −0.423 | 0.329 | 3.921 |
| −0.424 | 0.332 | 3.921 |
| −0.425 | 0.335 | 3.921 |
| −0.426 | 0.338 | 3.921 |
| −0.427 | 0.340 | 3.921 |
| −0.428 | 0.343 | 3.921 |
| −0.429 | 0.346 | 3.921 |
| −0.430 | 0.349 | 3.921 |
| −0.431 | 0.352 | 3.921 |
| −0.431 | 0.353 | 3.921 |
| −0.432 | 0.355 | 3.921 |
| −0.431 | 0.357 | 3.921 |
| −0.431 | 0.358 | 3.921 |
| −0.431 | 0.360 | 3.921 |
| −0.430 | 0.362 | 3.921 |
| −0.429 | 0.363 | 3.921 |
| −0.427 | 0.364 | 3.921 |
| −0.426 | 0.365 | 3.921 |
| −0.424 | 0.366 | 3.921 |
| −0.423 | 0.366 | 3.921 |
| −0.421 | 0.367 | 3.921 |
| −0.419 | 0.367 | 3.921 |
| −0.418 | 0.366 | 3.921 |
| −0.416 | 0.366 | 3.921 |
| −0.415 | 0.365 | 3.921 |
| −0.413 | 0.364 | 3.921 |
| −0.412 | 0.362 | 3.921 |
| −0.411 | 0.361 | 3.921 |
| −0.411 | 0.359 | 3.921 |
| −0.410 | 0.357 | 3.921 |
| −0.409 | 0.355 | 3.921 |
| −0.408 | 0.353 | 3.921 |
| −0.407 | 0.351 | 3.921 |
| −0.406 | 0.349 | 3.921 |
| −0.405 | 0.347 | 3.921 |
| −0.404 | 0.345 | 3.921 |
| −0.403 | 0.344 | 3.921 |
| −0.402 | 0.342 | 3.921 |
| −0.398 | 0.332 | 3.921 |
| −0.393 | 0.323 | 3.921 |
| −0.388 | 0.313 | 3.921 |
| −0.382 | 0.304 | 3.921 |
| −0.377 | 0.295 | 3.921 |
| −0.371 | 0.286 | 3.921 |
| −0.366 | 0.277 | 3.921 |
| −0.360 | 0.268 | 3.921 |
| −0.354 | 0.259 | 3.921 |
| −0.348 | 0.251 | 3.921 |
| −0.342 | 0.242 | 3.921 |
| −0.335 | 0.234 | 3.921 |
| −0.328 | 0.225 | 3.921 |
| −0.322 | 0.217 | 3.921 |
| −0.315 | 0.209 | 3.921 |
| −0.307 | 0.201 | 3.921 |
| −0.300 | 0.194 | 3.921 |
| −0.293 | 0.186 | 3.921 |
| −0.285 | 0.179 | 3.921 |
| −0.277 | 0.172 | 3.921 |
| −0.269 | 0.165 | 3.921 |
| −0.261 | 0.158 | 3.921 |
| −0.253 | 0.151 | 3.921 |
| −0.245 | 0.145 | 3.921 |
| −0.236 | 0.138 | 3.921 |
| −0.227 | 0.132 | 3.921 |
| −0.219 | 0.126 | 3.921 |
| −0.210 | 0.120 | 3.921 |
| −0.201 | 0.115 | 3.921 |
| −0.192 | 0.109 | 3.921 |

TABLE 2-continued

| X | Y | Z |
|---|---|---|
| −0.182 | 0.104 | 3.921 |
| −0.173 | 0.099 | 3.921 |
| −0.164 | 0.094 | 3.921 |
| −0.154 | 0.089 | 3.921 |
| −0.144 | 0.085 | 3.921 |
| −0.135 | 0.080 | 3.921 |
| −0.125 | 0.076 | 3.921 |
| −0.115 | 0.072 | 3.921 |
| −0.105 | 0.069 | 3.921 |
| −0.095 | 0.065 | 3.921 |
| −0.085 | 0.062 | 3.921 |
| −0.075 | 0.059 | 3.921 |
| −0.065 | 0.056 | 3.921 |
| −0.054 | 0.053 | 3.921 |
| −0.044 | 0.051 | 3.921 |
| −0.034 | 0.049 | 3.921 |
| −0.023 | 0.046 | 3.921 |
| −0.013 | 0.045 | 3.921 |
| −0.002 | 0.043 | 3.921 |
| 0.008 | 0.042 | 3.921 |
| 0.019 | 0.041 | 3.921 |
| 0.029 | 0.040 | 3.921 |
| 0.040 | 0.040 | 3.921 |
| 0.051 | 0.039 | 3.921 |
| 0.061 | 0.039 | 3.921 |
| 0.072 | 0.040 | 3.921 |
| 0.082 | 0.040 | 3.921 |
| 0.093 | 0.041 | 3.921 |
| 0.104 | 0.043 | 3.921 |
| 0.114 | 0.044 | 3.921 |
| 0.125 | 0.046 | 3.921 |
| 0.135 | 0.048 | 3.921 |
| 0.145 | 0.051 | 3.921 |
| 0.156 | 0.054 | 3.921 |
| 0.166 | 0.057 | 3.921 |
| 0.176 | 0.060 | 3.921 |
| 0.186 | 0.063 | 3.921 |
| 0.196 | 0.067 | 3.921 |
| 0.206 | 0.071 | 3.921 |
| 0.215 | 0.075 | 3.921 |
| 0.225 | 0.080 | 3.921 |
| 0.235 | 0.084 | 3.921 |
| 0.244 | 0.089 | 3.921 |
| 0.254 | 0.094 | 3.921 |
| 0.263 | 0.099 | 3.921 |
| 0.272 | 0.104 | 3.921 |
| 0.281 | 0.110 | 3.921 |
| 0.290 | 0.115 | 3.921 |
| 0.299 | 0.121 | 3.921 |
| 0.301 | 0.122 | 3.921 |
| 0.303 | 0.123 | 3.921 |
| 0.304 | 0.124 | 3.921 |
| 0.306 | 0.126 | 3.921 |
| 0.308 | 0.127 | 3.921 |
| 0.310 | 0.128 | 3.921 |
| 0.312 | 0.129 | 3.921 |
| 0.313 | 0.130 | 3.921 |
| 0.315 | 0.132 | 3.921 |
| 0.317 | 0.133 | 3.921 |
| 0.320 | 0.135 | 3.921 |
| 0.323 | 0.136 | 3.921 |
| 0.326 | 0.138 | 3.921 |
| 0.329 | 0.139 | 3.921 |
| 0.333 | 0.140 | 3.921 |
| 0.336 | 0.140 | 3.921 |
| 0.340 | 0.140 | 3.921 |
| 0.343 | 0.139 | 3.921 |
| 0.346 | 0.138 | 3.921 |
| 0.349 | 0.136 | 3.921 |
| 0.352 | 0.133 | 3.921 |
| 0.354 | 0.130 | 3.921 |
| 0.355 | 0.127 | 3.921 |
| 0.356 | 0.124 | 3.921 |
| 0.357 | 0.120 | 3.921 |
| 0.357 | 0.117 | 3.921 |
| 0.357 | 0.113 | 3.921 |
| 0.357 | 0.110 | 3.921 |

TABLE 2-continued

| X | Y | Z |
|---|---|---|
| SECTION 4 | | |
| 0.337 | 0.087 | 4.061 |
| 0.336 | 0.084 | 4.061 |
| 0.336 | 0.081 | 4.061 |
| 0.335 | 0.078 | 4.061 |
| 0.334 | 0.076 | 4.061 |
| 0.334 | 0.073 | 4.061 |
| 0.333 | 0.070 | 4.061 |
| 0.332 | 0.067 | 4.061 |
| 0.331 | 0.064 | 4.061 |
| 0.331 | 0.062 | 4.061 |
| 0.330 | 0.059 | 4.061 |
| 0.325 | 0.045 | 4.061 |
| 0.320 | 0.032 | 4.061 |
| 0.315 | 0.019 | 4.061 |
| 0.309 | 0.006 | 4.061 |
| 0.303 | −0.007 | 4.061 |
| 0.296 | −0.020 | 4.061 |
| 0.289 | −0.032 | 4.061 |
| 0.282 | −0.045 | 4.061 |
| 0.274 | −0.057 | 4.061 |
| 0.266 | −0.068 | 4.061 |
| 0.257 | −0.079 | 4.061 |
| 0.247 | −0.090 | 4.061 |
| 0.238 | −0.101 | 4.061 |
| 0.228 | −0.111 | 4.061 |
| 0.217 | −0.121 | 4.061 |
| 0.206 | −0.130 | 4.061 |
| 0.195 | −0.138 | 4.061 |
| 0.183 | −0.147 | 4.061 |
| 0.171 | −0.154 | 4.061 |
| 0.158 | −0.161 | 4.061 |
| 0.146 | −0.168 | 4.061 |
| 0.133 | −0.174 | 4.061 |
| 0.120 | −0.180 | 4.061 |
| 0.106 | −0.185 | 4.061 |
| 0.093 | −0.189 | 4.061 |
| 0.079 | −0.193 | 4.061 |
| 0.065 | −0.196 | 4.061 |
| 0.051 | −0.198 | 4.061 |
| 0.036 | −0.200 | 4.061 |
| 0.022 | −0.200 | 4.061 |
| 0.008 | −0.200 | 4.061 |
| −0.007 | −0.199 | 4.061 |
| −0.021 | −0.197 | 4.061 |
| −0.035 | −0.194 | 4.061 |
| −0.049 | −0.190 | 4.061 |
| −0.062 | −0.186 | 4.061 |
| −0.076 | −0.181 | 4.061 |
| −0.089 | −0.175 | 4.061 |
| −0.101 | −0.168 | 4.061 |
| −0.114 | −0.161 | 4.061 |
| −0.125 | −0.153 | 4.061 |
| −0.137 | −0.144 | 4.061 |
| −0.148 | −0.135 | 4.061 |
| −0.159 | −0.126 | 4.061 |
| −0.169 | −0.116 | 4.061 |
| −0.178 | −0.105 | 4.061 |
| −0.187 | −0.094 | 4.061 |
| −0.196 | −0.083 | 4.061 |
| −0.204 | −0.071 | 4.061 |
| −0.213 | −0.059 | 4.061 |
| −0.221 | −0.047 | 4.061 |
| −0.228 | −0.035 | 4.061 |
| −0.236 | −0.023 | 4.061 |
| −0.243 | −0.011 | 4.061 |
| −0.250 | 0.002 | 4.061 |
| −0.258 | 0.014 | 4.061 |
| −0.265 | 0.026 | 4.061 |
| −0.272 | 0.039 | 4.061 |
| −0.278 | 0.052 | 4.061 |
| −0.285 | 0.064 | 4.061 |
| −0.292 | 0.077 | 4.061 |
| −0.298 | 0.090 | 4.061 |
| −0.305 | 0.102 | 4.061 |
| −0.311 | 0.115 | 4.061 |
| −0.317 | 0.128 | 4.061 |
| −0.324 | 0.141 | 4.061 |

TABLE 2-continued

| X | Y | Z |
|---|---|---|
| −0.330 | 0.154 | 4.061 |
| −0.336 | 0.167 | 4.061 |
| −0.342 | 0.180 | 4.061 |
| −0.348 | 0.193 | 4.061 |
| −0.354 | 0.206 | 4.061 |
| −0.360 | 0.219 | 4.061 |
| −0.366 | 0.232 | 4.061 |
| −0.371 | 0.245 | 4.061 |
| −0.377 | 0.258 | 4.061 |
| −0.382 | 0.272 | 4.061 |
| −0.387 | 0.285 | 4.061 |
| −0.393 | 0.298 | 4.061 |
| −0.398 | 0.312 | 4.061 |
| −0.399 | 0.314 | 4.061 |
| −0.400 | 0.317 | 4.061 |
| −0.401 | 0.320 | 4.061 |
| −0.401 | 0.322 | 4.061 |
| −0.402 | 0.325 | 4.061 |
| −0.403 | 0.328 | 4.061 |
| −0.404 | 0.330 | 4.061 |
| −0.405 | 0.333 | 4.061 |
| −0.406 | 0.336 | 4.061 |
| −0.407 | 0.339 | 4.061 |
| −0.407 | 0.340 | 4.061 |
| −0.408 | 0.342 | 4.061 |
| −0.408 | 0.344 | 4.061 |
| −0.407 | 0.345 | 4.061 |
| −0.407 | 0.347 | 4.061 |
| −0.406 | 0.348 | 4.061 |
| −0.405 | 0.349 | 4.061 |
| −0.404 | 0.351 | 4.061 |
| −0.402 | 0.352 | 4.061 |
| −0.401 | 0.352 | 4.061 |
| −0.399 | 0.353 | 4.061 |
| −0.398 | 0.353 | 4.061 |
| −0.396 | 0.353 | 4.061 |
| −0.394 | 0.353 | 4.061 |
| −0.393 | 0.352 | 4.061 |
| −0.391 | 0.351 | 4.061 |
| −0.390 | 0.350 | 4.061 |
| −0.389 | 0.349 | 4.061 |
| −0.388 | 0.347 | 4.061 |
| −0.387 | 0.346 | 4.061 |
| −0.386 | 0.344 | 4.061 |
| −0.386 | 0.342 | 4.061 |
| −0.385 | 0.340 | 4.061 |
| −0.384 | 0.338 | 4.061 |
| −0.383 | 0.336 | 4.061 |
| −0.382 | 0.335 | 4.061 |
| −0.381 | 0.333 | 4.061 |
| −0.380 | 0.331 | 4.061 |
| −0.380 | 0.329 | 4.061 |
| −0.375 | 0.320 | 4.061 |
| −0.371 | 0.311 | 4.061 |
| −0.366 | 0.302 | 4.061 |
| −0.361 | 0.293 | 4.061 |
| −0.356 | 0.284 | 4.061 |
| −0.351 | 0.276 | 4.061 |
| −0.346 | 0.267 | 4.061 |
| −0.340 | 0.259 | 4.061 |
| −0.335 | 0.250 | 4.061 |
| −0.329 | 0.242 | 4.061 |
| −0.323 | 0.234 | 4.061 |
| −0.317 | 0.226 | 4.061 |
| −0.311 | 0.218 | 4.061 |
| −0.304 | 0.210 | 4.061 |
| −0.298 | 0.202 | 4.061 |
| −0.291 | 0.195 | 4.061 |
| −0.284 | 0.188 | 4.061 |
| −0.277 | 0.180 | 4.061 |
| −0.270 | 0.173 | 4.061 |
| −0.263 | 0.166 | 4.061 |
| −0.255 | 0.160 | 4.061 |
| −0.248 | 0.153 | 4.061 |
| −0.240 | 0.146 | 4.061 |
| −0.232 | 0.140 | 4.061 |
| −0.224 | 0.134 | 4.061 |
| −0.216 | 0.128 | 4.061 |

TABLE 2-continued

| X | Y | Z |
|---|---|---|
| −0.208 | 0.122 | 4.061 |
| −0.199 | 0.116 | 4.061 |
| −0.191 | 0.111 | 4.061 |
| −0.182 | 0.105 | 4.061 |
| −0.174 | 0.100 | 4.061 |
| −0.165 | 0.095 | 4.061 |
| −0.156 | 0.090 | 4.061 |
| −0.147 | 0.085 | 4.061 |
| −0.138 | 0.081 | 4.061 |
| −0.129 | 0.076 | 4.061 |
| −0.120 | 0.072 | 4.061 |
| −0.111 | 0.068 | 4.061 |
| −0.102 | 0.064 | 4.061 |
| −0.092 | 0.061 | 4.061 |
| −0.083 | 0.057 | 4.061 |
| −0.073 | 0.054 | 4.061 |
| −0.064 | 0.051 | 4.061 |
| −0.054 | 0.048 | 4.061 |
| −0.044 | 0.045 | 4.061 |
| −0.035 | 0.042 | 4.061 |
| −0.025 | 0.040 | 4.061 |
| −0.015 | 0.038 | 4.061 |
| −0.005 | 0.036 | 4.061 |
| 0.005 | 0.035 | 4.061 |
| 0.015 | 0.033 | 4.061 |
| 0.025 | 0.032 | 4.061 |
| 0.035 | 0.031 | 4.061 |
| 0.045 | 0.031 | 4.061 |
| 0.055 | 0.030 | 4.061 |
| 0.065 | 0.030 | 4.061 |
| 0.075 | 0.030 | 4.061 |
| 0.085 | 0.031 | 4.061 |
| 0.095 | 0.031 | 4.061 |
| 0.105 | 0.033 | 4.061 |
| 0.115 | 0.034 | 4.061 |
| 0.125 | 0.036 | 4.061 |
| 0.135 | 0.037 | 4.061 |
| 0.145 | 0.040 | 4.061 |
| 0.155 | 0.042 | 4.061 |
| 0.165 | 0.045 | 4.061 |
| 0.174 | 0.048 | 4.061 |
| 0.184 | 0.051 | 4.061 |
| 0.193 | 0.055 | 4.061 |
| 0.202 | 0.059 | 4.061 |
| 0.212 | 0.063 | 4.061 |
| 0.221 | 0.067 | 4.061 |
| 0.230 | 0.072 | 4.061 |
| 0.239 | 0.076 | 4.061 |
| 0.248 | 0.081 | 4.061 |
| 0.256 | 0.086 | 4.061 |
| 0.265 | 0.091 | 4.061 |
| 0.274 | 0.097 | 4.061 |
| 0.282 | 0.102 | 4.061 |
| 0.284 | 0.103 | 4.061 |
| 0.285 | 0.104 | 4.061 |
| 0.287 | 0.106 | 4.061 |
| 0.289 | 0.107 | 4.061 |
| 0.290 | 0.108 | 4.061 |
| 0.292 | 0.109 | 4.061 |
| 0.294 | 0.110 | 4.061 |
| 0.295 | 0.111 | 4.061 |
| 0.297 | 0.112 | 4.061 |
| 0.299 | 0.114 | 4.061 |
| 0.302 | 0.115 | 4.061 |
| 0.305 | 0.117 | 4.061 |
| 0.308 | 0.118 | 4.061 |
| 0.311 | 0.120 | 4.061 |
| 0.315 | 0.120 | 4.061 |
| 0.318 | 0.121 | 4.061 |
| 0.322 | 0.120 | 4.061 |
| 0.325 | 0.119 | 4.061 |
| 0.328 | 0.118 | 4.061 |
| 0.331 | 0.116 | 4.061 |
| 0.333 | 0.113 | 4.061 |
| 0.335 | 0.110 | 4.061 |
| 0.337 | 0.107 | 4.061 |
| 0.337 | 0.104 | 4.061 |
| 0.338 | 0.101 | 4.061 |

TABLE 2-continued

| X | Y | Z |
|---|---|---|
| 0.338 | 0.097 | 4.061 |
| 0.338 | 0.094 | 4.061 |
| 0.338 | 0.090 | 4.061 |
| | SECTION 5 | |
| 0.319 | 0.060 | 4.201 |
| 0.318 | 0.057 | 4.201 |
| 0.317 | 0.054 | 4.201 |
| 0.317 | 0.052 | 4.201 |
| 0.316 | 0.049 | 4.201 |
| 0.315 | 0.046 | 4.201 |
| 0.315 | 0.044 | 4.201 |
| 0.314 | 0.041 | 4.201 |
| 0.313 | 0.038 | 4.201 |
| 0.313 | 0.036 | 4.201 |
| 0.312 | 0.033 | 4.201 |
| 0.308 | 0.020 | 4.201 |
| 0.303 | 0.007 | 4.201 |
| 0.299 | −0.006 | 4.201 |
| 0.293 | −0.018 | 4.201 |
| 0.288 | −0.031 | 4.201 |
| 0.282 | −0.043 | 4.201 |
| 0.275 | −0.055 | 4.201 |
| 0.268 | −0.067 | 4.201 |
| 0.260 | −0.078 | 4.201 |
| 0.252 | −0.089 | 4.201 |
| 0.244 | −0.100 | 4.201 |
| 0.235 | −0.110 | 4.201 |
| 0.226 | −0.120 | 4.201 |
| 0.216 | −0.130 | 4.201 |
| 0.206 | −0.139 | 4.201 |
| 0.195 | −0.148 | 4.201 |
| 0.184 | −0.156 | 4.201 |
| 0.173 | −0.163 | 4.201 |
| 0.161 | −0.170 | 4.201 |
| 0.149 | −0.177 | 4.201 |
| 0.137 | −0.183 | 4.201 |
| 0.124 | −0.188 | 4.201 |
| 0.111 | −0.193 | 4.201 |
| 0.098 | −0.198 | 4.201 |
| 0.085 | −0.201 | 4.201 |
| 0.072 | −0.204 | 4.201 |
| 0.058 | −0.206 | 4.201 |
| 0.044 | −0.207 | 4.201 |
| 0.031 | −0.208 | 4.201 |
| 0.017 | −0.207 | 4.201 |
| 0.003 | −0.206 | 4.201 |
| −0.010 | −0.204 | 4.201 |
| −0.023 | −0.201 | 4.201 |
| −0.037 | −0.198 | 4.201 |
| −0.050 | −0.193 | 4.201 |
| −0.062 | −0.188 | 4.201 |
| −0.075 | −0.183 | 4.201 |
| −0.087 | −0.176 | 4.201 |
| −0.099 | −0.169 | 4.201 |
| −0.110 | −0.162 | 4.201 |
| −0.121 | −0.153 | 4.201 |
| −0.131 | −0.145 | 4.201 |
| −0.141 | −0.135 | 4.201 |
| −0.151 | −0.125 | 4.201 |
| −0.160 | −0.115 | 4.201 |
| −0.168 | −0.104 | 4.201 |
| −0.176 | −0.093 | 4.201 |
| −0.184 | −0.082 | 4.201 |
| −0.191 | −0.070 | 4.201 |
| −0.198 | −0.059 | 4.201 |
| −0.205 | −0.047 | 4.201 |
| −0.212 | −0.035 | 4.201 |
| −0.219 | −0.023 | 4.201 |
| −0.226 | −0.011 | 4.201 |
| −0.232 | 0.001 | 4.201 |
| −0.239 | 0.013 | 4.201 |
| −0.245 | 0.025 | 4.201 |
| −0.252 | 0.037 | 4.201 |
| −0.258 | 0.049 | 4.201 |
| −0.264 | 0.061 | 4.201 |
| −0.270 | 0.073 | 4.201 |
| −0.276 | 0.086 | 4.201 |

TABLE 2-continued

| X | Y | Z |
|---|---|---|
| −0.283 | 0.098 | 4.201 |
| −0.289 | 0.110 | 4.201 |
| −0.295 | 0.122 | 4.201 |
| −0.301 | 0.135 | 4.201 |
| −0.306 | 0.147 | 4.201 |
| −0.312 | 0.159 | 4.201 |
| −0.318 | 0.172 | 4.201 |
| −0.324 | 0.184 | 4.201 |
| −0.330 | 0.197 | 4.201 |
| −0.335 | 0.209 | 4.201 |
| −0.341 | 0.222 | 4.201 |
| −0.346 | 0.234 | 4.201 |
| −0.351 | 0.247 | 4.201 |
| −0.357 | 0.260 | 4.201 |
| −0.362 | 0.272 | 4.201 |
| −0.367 | 0.285 | 4.201 |
| −0.371 | 0.298 | 4.201 |
| −0.372 | 0.300 | 4.201 |
| −0.373 | 0.303 | 4.201 |
| −0.374 | 0.306 | 4.201 |
| −0.375 | 0.308 | 4.201 |
| −0.376 | 0.311 | 4.201 |
| −0.377 | 0.313 | 4.201 |
| −0.378 | 0.316 | 4.201 |
| −0.379 | 0.319 | 4.201 |
| −0.379 | 0.321 | 4.201 |
| −0.380 | 0.324 | 4.201 |
| −0.381 | 0.325 | 4.201 |
| −0.381 | 0.327 | 4.201 |
| −0.381 | 0.328 | 4.201 |
| −0.380 | 0.330 | 4.201 |
| −0.380 | 0.332 | 4.201 |
| −0.379 | 0.333 | 4.201 |
| −0.378 | 0.334 | 4.201 |
| −0.377 | 0.335 | 4.201 |
| −0.376 | 0.336 | 4.201 |
| −0.374 | 0.337 | 4.201 |
| −0.373 | 0.337 | 4.201 |
| −0.371 | 0.338 | 4.201 |
| −0.369 | 0.338 | 4.201 |
| −0.368 | 0.337 | 4.201 |
| −0.366 | 0.337 | 4.201 |
| −0.365 | 0.336 | 4.201 |
| −0.364 | 0.335 | 4.201 |
| −0.363 | 0.334 | 4.201 |
| −0.362 | 0.332 | 4.201 |
| −0.361 | 0.330 | 4.201 |
| −0.360 | 0.329 | 4.201 |
| −0.359 | 0.327 | 4.201 |
| −0.359 | 0.325 | 4.201 |
| −0.358 | 0.324 | 4.201 |
| −0.357 | 0.322 | 4.201 |
| −0.356 | 0.320 | 4.201 |
| −0.355 | 0.318 | 4.201 |
| −0.355 | 0.317 | 4.201 |
| −0.354 | 0.315 | 4.201 |
| −0.350 | 0.306 | 4.201 |
| −0.345 | 0.298 | 4.201 |
| −0.341 | 0.289 | 4.201 |
| −0.336 | 0.281 | 4.201 |
| −0.332 | 0.273 | 4.201 |
| −0.327 | 0.264 | 4.201 |
| −0.322 | 0.256 | 4.201 |
| −0.317 | 0.248 | 4.201 |
| −0.312 | 0.240 | 4.201 |
| −0.306 | 0.232 | 4.201 |
| −0.301 | 0.224 | 4.201 |
| −0.295 | 0.217 | 4.201 |
| −0.289 | 0.209 | 4.201 |
| −0.283 | 0.202 | 4.201 |
| −0.277 | 0.194 | 4.201 |
| −0.271 | 0.187 | 4.201 |
| −0.265 | 0.180 | 4.201 |
| −0.258 | 0.173 | 4.201 |
| −0.252 | 0.166 | 4.201 |
| −0.245 | 0.159 | 4.201 |
| −0.238 | 0.153 | 4.201 |
| −0.231 | 0.146 | 4.201 |

TABLE 2-continued

| X | Y | Z |
|---|---|---|
| −0.224 | 0.140 | 4.201 |
| −0.217 | 0.134 | 4.201 |
| −0.209 | 0.128 | 4.201 |
| −0.202 | 0.122 | 4.201 |
| −0.195 | 0.116 | 4.201 |
| −0.187 | 0.110 | 4.201 |
| −0.179 | 0.104 | 4.201 |
| −0.171 | 0.099 | 4.201 |
| −0.163 | 0.094 | 4.201 |
| −0.155 | 0.088 | 4.201 |
| −0.147 | 0.083 | 4.201 |
| −0.139 | 0.078 | 4.201 |
| −0.131 | 0.074 | 4.201 |
| −0.123 | 0.069 | 4.201 |
| −0.114 | 0.065 | 4.201 |
| −0.106 | 0.060 | 4.201 |
| −0.097 | 0.056 | 4.201 |
| −0.088 | 0.052 | 4.201 |
| −0.080 | 0.048 | 4.201 |
| −0.071 | 0.045 | 4.201 |
| −0.062 | 0.041 | 4.201 |
| −0.053 | 0.038 | 4.201 |
| −0.044 | 0.035 | 4.201 |
| −0.035 | 0.032 | 4.201 |
| −0.026 | 0.029 | 4.201 |
| −0.016 | 0.027 | 4.201 |
| −0.007 | 0.024 | 4.201 |
| 0.002 | 0.022 | 4.201 |
| 0.011 | 0.020 | 4.201 |
| 0.021 | 0.019 | 4.201 |
| 0.030 | 0.017 | 4.201 |
| 0.040 | 0.016 | 4.201 |
| 0.049 | 0.015 | 4.201 |
| 0.059 | 0.015 | 4.201 |
| 0.068 | 0.014 | 4.201 |
| 0.078 | 0.014 | 4.201 |
| 0.087 | 0.014 | 4.201 |
| 0.097 | 0.015 | 4.201 |
| 0.106 | 0.015 | 4.201 |
| 0.116 | 0.017 | 4.201 |
| 0.125 | 0.018 | 4.201 |
| 0.135 | 0.019 | 4.201 |
| 0.144 | 0.021 | 4.201 |
| 0.153 | 0.024 | 4.201 |
| 0.163 | 0.026 | 4.201 |
| 0.172 | 0.029 | 4.201 |
| 0.181 | 0.032 | 4.201 |
| 0.190 | 0.035 | 4.201 |
| 0.199 | 0.039 | 4.201 |
| 0.207 | 0.043 | 4.201 |
| 0.216 | 0.047 | 4.201 |
| 0.224 | 0.051 | 4.201 |
| 0.233 | 0.056 | 4.201 |
| 0.241 | 0.061 | 4.201 |
| 0.249 | 0.066 | 4.201 |
| 0.257 | 0.071 | 4.201 |
| 0.265 | 0.076 | 4.201 |
| 0.267 | 0.077 | 4.201 |
| 0.269 | 0.078 | 4.201 |
| 0.270 | 0.079 | 4.201 |
| 0.272 | 0.080 | 4.201 |
| 0.273 | 0.081 | 4.201 |
| 0.275 | 0.082 | 4.201 |
| 0.276 | 0.083 | 4.201 |
| 0.278 | 0.084 | 4.201 |
| 0.280 | 0.085 | 4.201 |
| 0.281 | 0.086 | 4.201 |
| 0.284 | 0.088 | 4.201 |
| 0.287 | 0.090 | 4.201 |
| 0.290 | 0.091 | 4.201 |
| 0.294 | 0.092 | 4.201 |
| 0.297 | 0.093 | 4.201 |
| 0.300 | 0.093 | 4.201 |
| 0.304 | 0.093 | 4.201 |
| 0.307 | 0.092 | 4.201 |
| 0.310 | 0.091 | 4.201 |
| 0.313 | 0.089 | 4.201 |
| 0.315 | 0.086 | 4.201 |

TABLE 2-continued

| X | Y | Z |
|---|---|---|
| 0.317 | 0.083 | 4.201 |
| 0.318 | 0.080 | 4.201 |
| 0.319 | 0.077 | 4.201 |
| 0.320 | 0.073 | 4.201 |
| 0.320 | 0.070 | 4.201 |
| 0.320 | 0.066 | 4.201 |
| 0.319 | 0.063 | 4.201 |
| SECTION 6 | | |
| 0.301 | 0.025 | 4.341 |
| 0.300 | 0.022 | 4.341 |
| 0.300 | 0.019 | 4.341 |
| 0.299 | 0.017 | 4.341 |
| 0.298 | 0.014 | 4.341 |
| 0.298 | 0.012 | 4.341 |
| 0.297 | 0.009 | 4.341 |
| 0.296 | 0.007 | 4.341 |
| 0.296 | 0.004 | 4.341 |
| 0.295 | 0.002 | 4.341 |
| 0.294 | −0.001 | 4.341 |
| 0.290 | −0.013 | 4.341 |
| 0.286 | −0.026 | 4.341 |
| 0.282 | −0.038 | 4.341 |
| 0.277 | −0.050 | 4.341 |
| 0.272 | −0.062 | 4.341 |
| 0.266 | −0.074 | 4.341 |
| 0.260 | −0.085 | 4.341 |
| 0.254 | −0.097 | 4.341 |
| 0.247 | −0.108 | 4.341 |
| 0.239 | −0.118 | 4.341 |
| 0.231 | −0.129 | 4.341 |
| 0.222 | −0.138 | 4.341 |
| 0.214 | −0.148 | 4.341 |
| 0.204 | −0.157 | 4.341 |
| 0.194 | −0.165 | 4.341 |
| 0.184 | −0.173 | 4.341 |
| 0.173 | −0.181 | 4.341 |
| 0.162 | −0.188 | 4.341 |
| 0.151 | −0.194 | 4.341 |
| 0.139 | −0.200 | 4.341 |
| 0.127 | −0.205 | 4.341 |
| 0.115 | −0.210 | 4.341 |
| 0.103 | −0.214 | 4.341 |
| 0.090 | −0.217 | 4.341 |
| 0.077 | −0.220 | 4.341 |
| 0.064 | −0.222 | 4.341 |
| 0.051 | −0.223 | 4.341 |
| 0.038 | −0.223 | 4.341 |
| 0.025 | −0.222 | 4.341 |
| 0.012 | −0.221 | 4.341 |
| −0.001 | −0.218 | 4.341 |
| −0.013 | −0.215 | 4.341 |
| −0.026 | −0.211 | 4.341 |
| −0.038 | −0.206 | 4.341 |
| −0.050 | −0.200 | 4.341 |
| −0.061 | −0.194 | 4.341 |
| −0.072 | −0.187 | 4.341 |
| −0.083 | −0.180 | 4.341 |
| −0.094 | −0.172 | 4.341 |
| −0.104 | −0.164 | 4.341 |
| −0.113 | −0.155 | 4.341 |
| −0.122 | −0.146 | 4.341 |
| −0.131 | −0.136 | 4.341 |
| −0.139 | −0.126 | 4.341 |
| −0.147 | −0.116 | 4.341 |
| −0.154 | −0.105 | 4.341 |
| −0.161 | −0.094 | 4.341 |
| −0.168 | −0.083 | 4.341 |
| −0.174 | −0.071 | 4.341 |
| −0.181 | −0.060 | 4.341 |
| −0.187 | −0.048 | 4.341 |
| −0.193 | −0.037 | 4.341 |
| −0.199 | −0.025 | 4.341 |
| −0.205 | −0.014 | 4.341 |
| −0.211 | −0.002 | 4.341 |
| −0.217 | 0.010 | 4.341 |
| −0.223 | 0.021 | 4.341 |
| −0.229 | 0.033 | 4.341 |

TABLE 2-continued

| X | Y | Z |
|---|---|---|
| −0.234 | 0.045 | 4.341 |
| −0.240 | 0.056 | 4.341 |
| −0.246 | 0.068 | 4.341 |
| −0.252 | 0.080 | 4.341 |
| −0.257 | 0.092 | 4.341 |
| −0.263 | 0.103 | 4.341 |
| −0.269 | 0.115 | 4.341 |
| −0.274 | 0.127 | 4.341 |
| −0.280 | 0.139 | 4.341 |
| −0.286 | 0.150 | 4.341 |
| −0.291 | 0.162 | 4.341 |
| −0.297 | 0.174 | 4.341 |
| −0.302 | 0.186 | 4.341 |
| −0.307 | 0.198 | 4.341 |
| −0.313 | 0.210 | 4.341 |
| −0.318 | 0.222 | 4.341 |
| −0.323 | 0.234 | 4.341 |
| −0.328 | 0.246 | 4.341 |
| −0.333 | 0.258 | 4.341 |
| −0.338 | 0.270 | 4.341 |
| −0.342 | 0.282 | 4.341 |
| −0.343 | 0.285 | 4.341 |
| −0.344 | 0.287 | 4.341 |
| −0.345 | 0.290 | 4.341 |
| −0.346 | 0.292 | 4.341 |
| −0.346 | 0.295 | 4.341 |
| −0.347 | 0.297 | 4.341 |
| −0.348 | 0.300 | 4.341 |
| −0.349 | 0.302 | 4.341 |
| −0.350 | 0.304 | 4.341 |
| −0.351 | 0.307 | 4.341 |
| −0.351 | 0.308 | 4.341 |
| −0.351 | 0.310 | 4.341 |
| −0.351 | 0.312 | 4.341 |
| −0.351 | 0.313 | 4.341 |
| −0.350 | 0.315 | 4.341 |
| −0.349 | 0.316 | 4.341 |
| −0.348 | 0.317 | 4.341 |
| −0.347 | 0.318 | 4.341 |
| −0.346 | 0.319 | 4.341 |
| −0.345 | 0.320 | 4.341 |
| −0.343 | 0.320 | 4.341 |
| −0.341 | 0.321 | 4.341 |
| −0.340 | 0.321 | 4.341 |
| −0.338 | 0.320 | 4.341 |
| −0.337 | 0.320 | 4.341 |
| −0.335 | 0.319 | 4.341 |
| −0.334 | 0.318 | 4.341 |
| −0.333 | 0.317 | 4.341 |
| −0.333 | 0.315 | 4.341 |
| −0.332 | 0.314 | 4.341 |
| −0.331 | 0.312 | 4.341 |
| −0.330 | 0.310 | 4.341 |
| −0.329 | 0.309 | 4.341 |
| −0.329 | 0.307 | 4.341 |
| −0.328 | 0.305 | 4.341 |
| −0.327 | 0.304 | 4.341 |
| −0.326 | 0.302 | 4.341 |
| −0.326 | 0.301 | 4.341 |
| −0.325 | 0.299 | 4.341 |
| −0.321 | 0.291 | 4.341 |
| −0.317 | 0.283 | 4.341 |
| −0.313 | 0.275 | 4.341 |
| −0.308 | 0.267 | 4.341 |
| −0.304 | 0.259 | 4.341 |
| −0.300 | 0.251 | 4.341 |
| −0.295 | 0.243 | 4.341 |
| −0.290 | 0.236 | 4.341 |
| −0.285 | 0.228 | 4.341 |
| −0.280 | 0.221 | 4.341 |
| −0.275 | 0.213 | 4.341 |
| −0.270 | 0.206 | 4.341 |
| −0.265 | 0.199 | 4.341 |
| −0.259 | 0.192 | 4.341 |
| −0.254 | 0.185 | 4.341 |
| −0.248 | 0.178 | 4.341 |
| −0.242 | 0.171 | 4.341 |
| −0.236 | 0.164 | 4.341 |

TABLE 2-continued

| X | Y | Z |
|---|---|---|
| −0.230 | 0.157 | 4.341 |
| −0.224 | 0.151 | 4.341 |
| −0.218 | 0.144 | 4.341 |
| −0.212 | 0.138 | 4.341 |
| −0.205 | 0.131 | 4.341 |
| −0.199 | 0.125 | 4.341 |
| −0.192 | 0.119 | 4.341 |
| −0.185 | 0.113 | 4.341 |
| −0.179 | 0.107 | 4.341 |
| −0.172 | 0.101 | 4.341 |
| −0.165 | 0.095 | 4.341 |
| −0.158 | 0.090 | 4.341 |
| −0.151 | 0.084 | 4.341 |
| −0.144 | 0.079 | 4.341 |
| −0.136 | 0.074 | 4.341 |
| −0.129 | 0.068 | 4.341 |
| −0.121 | 0.063 | 4.341 |
| −0.114 | 0.058 | 4.341 |
| −0.106 | 0.054 | 4.341 |
| −0.099 | 0.049 | 4.341 |
| −0.091 | 0.044 | 4.341 |
| −0.083 | 0.040 | 4.341 |
| −0.075 | 0.036 | 4.341 |
| −0.067 | 0.032 | 4.341 |
| −0.059 | 0.028 | 4.341 |
| −0.051 | 0.024 | 4.341 |
| −0.042 | 0.020 | 4.341 |
| −0.034 | 0.017 | 4.341 |
| −0.026 | 0.014 | 4.341 |
| −0.017 | 0.010 | 4.341 |
| −0.009 | 0.008 | 4.341 |
| 0.000 | 0.005 | 4.341 |
| 0.008 | 0.002 | 4.341 |
| 0.017 | 0.000 | 4.341 |
| 0.026 | −0.002 | 4.341 |
| 0.035 | −0.004 | 4.341 |
| 0.044 | −0.005 | 4.341 |
| 0.052 | −0.007 | 4.341 |
| 0.061 | −0.008 | 4.341 |
| 0.070 | −0.009 | 4.341 |
| 0.079 | −0.009 | 4.341 |
| 0.088 | −0.009 | 4.341 |
| 0.097 | −0.009 | 4.341 |
| 0.106 | −0.009 | 4.341 |
| 0.115 | −0.008 | 4.341 |
| 0.124 | −0.007 | 4.341 |
| 0.133 | −0.006 | 4.341 |
| 0.142 | −0.004 | 4.341 |
| 0.151 | −0.002 | 4.341 |
| 0.160 | 0.000 | 4.341 |
| 0.168 | 0.002 | 4.341 |
| 0.177 | 0.005 | 4.341 |
| 0.185 | 0.008 | 4.341 |
| 0.194 | 0.012 | 4.341 |
| 0.202 | 0.015 | 4.341 |
| 0.210 | 0.019 | 4.341 |
| 0.218 | 0.023 | 4.341 |
| 0.226 | 0.028 | 4.341 |
| 0.234 | 0.032 | 4.341 |
| 0.241 | 0.037 | 4.341 |
| 0.249 | 0.042 | 4.341 |
| 0.250 | 0.043 | 4.341 |
| 0.252 | 0.044 | 4.341 |
| 0.253 | 0.045 | 4.341 |
| 0.255 | 0.046 | 4.341 |
| 0.256 | 0.047 | 4.341 |
| 0.258 | 0.048 | 4.341 |
| 0.259 | 0.049 | 4.341 |
| 0.261 | 0.050 | 4.341 |
| 0.262 | 0.051 | 4.341 |
| 0.264 | 0.051 | 4.341 |
| 0.267 | 0.053 | 4.341 |
| 0.270 | 0.055 | 4.341 |
| 0.273 | 0.056 | 4.341 |
| 0.276 | 0.057 | 4.341 |
| 0.280 | 0.058 | 4.341 |
| 0.283 | 0.058 | 4.341 |
| 0.286 | 0.058 | 4.341 |

TABLE 2-continued

| X | Y | Z |
|---|---|---|
| 0.290 | 0.057 | 4.341 |
| 0.293 | 0.055 | 4.341 |
| 0.295 | 0.053 | 4.341 |
| 0.298 | 0.051 | 4.341 |
| 0.299 | 0.048 | 4.341 |
| 0.301 | 0.045 | 4.341 |
| 0.302 | 0.041 | 4.341 |
| 0.302 | 0.038 | 4.341 |
| 0.302 | 0.035 | 4.341 |
| 0.302 | 0.031 | 4.341 |
| 0.301 | 0.028 | 4.341 |
| | SECTION 7 | |
| 0.283 | −0.019 | 4.481 |
| 0.283 | −0.021 | 4.481 |
| 0.282 | −0.024 | 4.481 |
| 0.281 | −0.026 | 4.481 |
| 0.281 | −0.028 | 4.481 |
| 0.280 | −0.031 | 4.481 |
| 0.279 | −0.033 | 4.481 |
| 0.279 | −0.036 | 4.481 |
| 0.278 | −0.038 | 4.481 |
| 0.277 | −0.040 | 4.481 |
| 0.277 | −0.043 | 4.481 |
| 0.273 | −0.055 | 4.481 |
| 0.269 | −0.067 | 4.481 |
| 0.264 | −0.078 | 4.481 |
| 0.260 | −0.090 | 4.481 |
| 0.255 | −0.101 | 4.481 |
| 0.249 | −0.113 | 4.481 |
| 0.244 | −0.124 | 4.481 |
| 0.237 | −0.134 | 4.481 |
| 0.231 | −0.145 | 4.481 |
| 0.224 | −0.155 | 4.481 |
| 0.216 | −0.165 | 4.481 |
| 0.208 | −0.175 | 4.481 |
| 0.200 | −0.184 | 4.481 |
| 0.191 | −0.193 | 4.481 |
| 0.182 | −0.201 | 4.481 |
| 0.172 | −0.209 | 4.481 |
| 0.162 | −0.216 | 4.481 |
| 0.151 | −0.223 | 4.481 |
| 0.140 | −0.229 | 4.481 |
| 0.129 | −0.234 | 4.481 |
| 0.117 | −0.239 | 4.481 |
| 0.106 | −0.243 | 4.481 |
| 0.093 | −0.246 | 4.481 |
| 0.081 | −0.248 | 4.481 |
| 0.069 | −0.249 | 4.481 |
| 0.056 | −0.249 | 4.481 |
| 0.044 | −0.249 | 4.481 |
| 0.031 | −0.248 | 4.481 |
| 0.019 | −0.245 | 4.481 |
| 0.007 | −0.242 | 4.481 |
| −0.005 | −0.238 | 4.481 |
| −0.016 | −0.232 | 4.481 |
| −0.027 | −0.226 | 4.481 |
| −0.037 | −0.220 | 4.481 |
| −0.048 | −0.212 | 4.481 |
| −0.057 | −0.205 | 4.481 |
| −0.067 | −0.197 | 4.481 |
| −0.076 | −0.188 | 4.481 |
| −0.085 | −0.179 | 4.481 |
| −0.093 | −0.170 | 4.481 |
| −0.101 | −0.160 | 4.481 |
| −0.109 | −0.150 | 4.481 |
| −0.116 | −0.140 | 4.481 |
| −0.123 | −0.130 | 4.481 |
| −0.129 | −0.119 | 4.481 |
| −0.136 | −0.108 | 4.481 |
| −0.142 | −0.097 | 4.481 |
| −0.147 | −0.086 | 4.481 |
| −0.153 | −0.075 | 4.481 |
| −0.159 | −0.064 | 4.481 |
| −0.164 | −0.053 | 4.481 |
| −0.170 | −0.042 | 4.481 |
| −0.175 | −0.030 | 4.481 |
| −0.181 | −0.019 | 4.481 |

TABLE 2-continued

| X | Y | Z |
|---|---|---|
| −0.186 | −0.008 | 4.481 |
| −0.191 | 0.003 | 4.481 |
| −0.197 | 0.015 | 4.481 |
| −0.202 | 0.026 | 4.481 |
| −0.207 | 0.037 | 4.481 |
| −0.213 | 0.048 | 4.481 |
| −0.218 | 0.060 | 4.481 |
| −0.223 | 0.071 | 4.481 |
| −0.229 | 0.082 | 4.481 |
| −0.234 | 0.094 | 4.481 |
| −0.239 | 0.105 | 4.481 |
| −0.245 | 0.116 | 4.481 |
| −0.250 | 0.127 | 4.481 |
| −0.255 | 0.139 | 4.481 |
| −0.261 | 0.150 | 4.481 |
| −0.266 | 0.161 | 4.481 |
| −0.271 | 0.173 | 4.481 |
| −0.276 | 0.184 | 4.481 |
| −0.281 | 0.196 | 4.481 |
| −0.287 | 0.207 | 4.481 |
| −0.292 | 0.218 | 4.481 |
| −0.296 | 0.230 | 4.481 |
| −0.301 | 0.241 | 4.481 |
| −0.306 | 0.253 | 4.481 |
| −0.310 | 0.265 | 4.481 |
| −0.311 | 0.267 | 4.481 |
| −0.312 | 0.269 | 4.481 |
| −0.313 | 0.272 | 4.481 |
| −0.313 | 0.274 | 4.481 |
| −0.314 | 0.277 | 4.481 |
| −0.315 | 0.279 | 4.481 |
| −0.316 | 0.281 | 4.481 |
| −0.317 | 0.284 | 4.481 |
| −0.317 | 0.286 | 4.481 |
| −0.318 | 0.288 | 4.481 |
| −0.318 | 0.290 | 4.481 |
| −0.319 | 0.291 | 4.481 |
| −0.319 | 0.293 | 4.481 |
| −0.318 | 0.295 | 4.481 |
| −0.318 | 0.296 | 4.481 |
| −0.317 | 0.297 | 4.481 |
| −0.316 | 0.299 | 4.481 |
| −0.315 | 0.300 | 4.481 |
| −0.313 | 0.300 | 4.481 |
| −0.312 | 0.301 | 4.481 |
| −0.310 | 0.302 | 4.481 |
| −0.309 | 0.302 | 4.481 |
| −0.307 | 0.302 | 4.481 |
| −0.306 | 0.301 | 4.481 |
| −0.304 | 0.301 | 4.481 |
| −0.303 | 0.300 | 4.481 |
| −0.302 | 0.299 | 4.481 |
| −0.301 | 0.298 | 4.481 |
| −0.300 | 0.296 | 4.481 |
| −0.299 | 0.295 | 4.481 |
| −0.299 | 0.293 | 4.481 |
| −0.298 | 0.292 | 4.481 |
| −0.297 | 0.290 | 4.481 |
| −0.296 | 0.289 | 4.481 |
| −0.296 | 0.287 | 4.481 |
| −0.295 | 0.286 | 4.481 |
| −0.294 | 0.284 | 4.481 |
| −0.294 | 0.283 | 4.481 |
| −0.293 | 0.281 | 4.481 |
| −0.289 | 0.273 | 4.481 |
| −0.285 | 0.266 | 4.481 |
| −0.281 | 0.258 | 4.481 |
| −0.277 | 0.251 | 4.481 |
| −0.273 | 0.243 | 4.481 |
| −0.269 | 0.236 | 4.481 |
| −0.264 | 0.229 | 4.481 |
| −0.260 | 0.222 | 4.481 |
| −0.256 | 0.214 | 4.481 |
| −0.251 | 0.207 | 4.481 |
| −0.246 | 0.200 | 4.481 |
| −0.241 | 0.193 | 4.481 |
| −0.237 | 0.186 | 4.481 |
| −0.232 | 0.179 | 4.481 |

TABLE 2-continued

| X | Y | Z |
|---|---|---|
| −0.227 | 0.172 | 4.481 |
| −0.221 | 0.166 | 4.481 |
| −0.216 | 0.159 | 4.481 |
| −0.211 | 0.152 | 4.481 |
| −0.206 | 0.146 | 4.481 |
| −0.200 | 0.139 | 4.481 |
| −0.195 | 0.133 | 4.481 |
| −0.189 | 0.126 | 4.481 |
| −0.183 | 0.120 | 4.481 |
| −0.178 | 0.114 | 4.481 |
| −0.172 | 0.108 | 4.481 |
| −0.166 | 0.101 | 4.481 |
| −0.160 | 0.095 | 4.481 |
| −0.154 | 0.089 | 4.481 |
| −0.148 | 0.083 | 4.481 |
| −0.142 | 0.078 | 4.481 |
| −0.136 | 0.072 | 4.481 |
| −0.129 | 0.066 | 4.481 |
| −0.123 | 0.061 | 4.481 |
| −0.116 | 0.055 | 4.481 |
| −0.110 | 0.050 | 4.481 |
| −0.103 | 0.044 | 4.481 |
| −0.097 | 0.039 | 4.481 |
| −0.090 | 0.034 | 4.481 |
| −0.083 | 0.029 | 4.481 |
| −0.076 | 0.024 | 4.481 |
| −0.069 | 0.019 | 4.481 |
| −0.062 | 0.015 | 4.481 |
| −0.055 | 0.010 | 4.481 |
| −0.047 | 0.006 | 4.481 |
| −0.040 | 0.002 | 4.481 |
| −0.033 | −0.003 | 4.481 |
| −0.025 | −0.006 | 4.481 |
| −0.018 | −0.010 | 4.481 |
| −0.010 | −0.014 | 4.481 |
| −0.002 | −0.017 | 4.481 |
| 0.006 | −0.021 | 4.481 |
| 0.014 | −0.024 | 4.481 |
| 0.022 | −0.026 | 4.481 |
| 0.030 | −0.029 | 4.481 |
| 0.038 | −0.031 | 4.481 |
| 0.046 | −0.034 | 4.481 |
| 0.054 | −0.035 | 4.481 |
| 0.063 | −0.037 | 4.481 |
| 0.071 | −0.038 | 4.481 |
| 0.079 | −0.039 | 4.481 |
| 0.088 | −0.040 | 4.481 |
| 0.096 | −0.041 | 4.481 |
| 0.105 | −0.041 | 4.481 |
| 0.113 | −0.040 | 4.481 |
| 0.122 | −0.040 | 4.481 |
| 0.130 | −0.039 | 4.481 |
| 0.139 | −0.038 | 4.481 |
| 0.147 | −0.036 | 4.481 |
| 0.155 | −0.034 | 4.481 |
| 0.163 | −0.032 | 4.481 |
| 0.172 | −0.030 | 4.481 |
| 0.180 | −0.027 | 4.481 |
| 0.188 | −0.024 | 4.481 |
| 0.195 | −0.020 | 4.481 |
| 0.203 | −0.017 | 4.481 |
| 0.211 | −0.013 | 4.481 |
| 0.218 | −0.009 | 4.481 |
| 0.226 | −0.005 | 4.481 |
| 0.233 | −0.001 | 4.481 |
| 0.234 | 0.000 | 4.481 |
| 0.236 | 0.001 | 4.481 |
| 0.237 | 0.002 | 4.481 |
| 0.239 | 0.003 | 4.481 |
| 0.240 | 0.004 | 4.481 |
| 0.242 | 0.005 | 4.481 |
| 0.243 | 0.006 | 4.481 |
| 0.244 | 0.007 | 4.481 |
| 0.246 | 0.007 | 4.481 |
| 0.247 | 0.008 | 4.481 |
| 0.250 | 0.010 | 4.481 |
| 0.253 | 0.012 | 4.481 |
| 0.256 | 0.013 | 4.481 |

TABLE 2-continued

| X | Y | Z |
|---|---|---|
| 0.260 | 0.014 | 4.481 |
| 0.263 | 0.014 | 4.481 |
| 0.266 | 0.014 | 4.481 |
| 0.270 | 0.014 | 4.481 |
| 0.273 | 0.013 | 4.481 |
| 0.276 | 0.012 | 4.481 |
| 0.278 | 0.010 | 4.481 |
| 0.281 | 0.007 | 4.481 |
| 0.282 | 0.004 | 4.481 |
| 0.284 | 0.001 | 4.481 |
| 0.284 | −0.002 | 4.481 |
| 0.285 | −0.005 | 4.481 |
| 0.285 | −0.009 | 4.481 |
| 0.285 | −0.012 | 4.481 |
| 0.284 | −0.015 | 4.481 |
| SECTION 8 | | |
| 0.266 | −0.071 | 4.621 |
| 0.266 | −0.073 | 4.621 |
| 0.265 | −0.075 | 4.621 |
| 0.264 | −0.078 | 4.621 |
| 0.264 | −0.080 | 4.621 |
| 0.263 | −0.082 | 4.621 |
| 0.262 | −0.084 | 4.621 |
| 0.262 | −0.087 | 4.621 |
| 0.261 | −0.089 | 4.621 |
| 0.260 | −0.091 | 4.621 |
| 0.259 | −0.094 | 4.621 |
| 0.255 | −0.105 | 4.621 |
| 0.251 | −0.116 | 4.621 |
| 0.247 | −0.127 | 4.621 |
| 0.242 | −0.138 | 4.621 |
| 0.237 | −0.149 | 4.621 |
| 0.231 | −0.159 | 4.621 |
| 0.225 | −0.170 | 4.621 |
| 0.219 | −0.180 | 4.621 |
| 0.213 | −0.190 | 4.621 |
| 0.206 | −0.200 | 4.621 |
| 0.199 | −0.210 | 4.621 |
| 0.192 | −0.219 | 4.621 |
| 0.184 | −0.228 | 4.621 |
| 0.176 | −0.237 | 4.621 |
| 0.167 | −0.245 | 4.621 |
| 0.158 | −0.252 | 4.621 |
| 0.148 | −0.259 | 4.621 |
| 0.137 | −0.265 | 4.621 |
| 0.127 | −0.270 | 4.621 |
| 0.115 | −0.275 | 4.621 |
| 0.104 | −0.278 | 4.621 |
| 0.092 | −0.280 | 4.621 |
| 0.080 | −0.282 | 4.621 |
| 0.069 | −0.282 | 4.621 |
| 0.057 | −0.282 | 4.621 |
| 0.045 | −0.280 | 4.621 |
| 0.033 | −0.278 | 4.621 |
| 0.022 | −0.275 | 4.621 |
| 0.010 | −0.270 | 4.621 |
| 0.000 | −0.265 | 4.621 |
| −0.011 | −0.259 | 4.621 |
| −0.020 | −0.252 | 4.621 |
| −0.029 | −0.244 | 4.621 |
| −0.037 | −0.235 | 4.621 |
| −0.045 | −0.226 | 4.621 |
| −0.053 | −0.217 | 4.621 |
| −0.060 | −0.208 | 4.621 |
| −0.067 | −0.198 | 4.621 |
| −0.074 | −0.188 | 4.621 |
| −0.080 | −0.178 | 4.621 |
| −0.086 | −0.168 | 4.621 |
| −0.092 | −0.157 | 4.621 |
| −0.098 | −0.147 | 4.621 |
| −0.103 | −0.136 | 4.621 |
| −0.109 | −0.126 | 4.621 |
| −0.114 | −0.115 | 4.621 |
| −0.119 | −0.104 | 4.621 |
| −0.124 | −0.093 | 4.621 |
| −0.129 | −0.082 | 4.621 |
| −0.134 | −0.071 | 4.621 |

TABLE 2-continued

| X | Y | Z |
|---|---|---|
| −0.139 | −0.060 | 4.621 |
| −0.144 | −0.049 | 4.621 |
| −0.149 | −0.039 | 4.621 |
| −0.153 | −0.028 | 4.621 |
| −0.158 | −0.017 | 4.621 |
| −0.163 | −0.006 | 4.621 |
| −0.168 | 0.005 | 4.621 |
| −0.173 | 0.016 | 4.621 |
| −0.178 | 0.027 | 4.621 |
| −0.182 | 0.038 | 4.621 |
| −0.187 | 0.049 | 4.621 |
| −0.192 | 0.060 | 4.621 |
| −0.197 | 0.071 | 4.621 |
| −0.202 | 0.081 | 4.621 |
| −0.207 | 0.092 | 4.621 |
| −0.212 | 0.103 | 4.621 |
| −0.217 | 0.114 | 4.621 |
| −0.222 | 0.125 | 4.621 |
| −0.227 | 0.136 | 4.621 |
| −0.232 | 0.147 | 4.621 |
| −0.237 | 0.158 | 4.621 |
| −0.242 | 0.169 | 4.621 |
| −0.247 | 0.179 | 4.621 |
| −0.251 | 0.190 | 4.621 |
| −0.256 | 0.201 | 4.621 |
| −0.261 | 0.212 | 4.621 |
| −0.266 | 0.223 | 4.621 |
| −0.271 | 0.234 | 4.621 |
| −0.275 | 0.245 | 4.621 |
| −0.276 | 0.247 | 4.621 |
| −0.277 | 0.250 | 4.621 |
| −0.277 | 0.252 | 4.621 |
| −0.278 | 0.254 | 4.621 |
| −0.279 | 0.257 | 4.621 |
| −0.280 | 0.259 | 4.621 |
| −0.280 | 0.261 | 4.621 |
| −0.281 | 0.263 | 4.621 |
| −0.282 | 0.266 | 4.621 |
| −0.283 | 0.268 | 4.621 |
| −0.283 | 0.269 | 4.621 |
| −0.283 | 0.271 | 4.621 |
| −0.283 | 0.273 | 4.621 |
| −0.283 | 0.274 | 4.621 |
| −0.282 | 0.275 | 4.621 |
| −0.281 | 0.277 | 4.621 |
| −0.280 | 0.278 | 4.621 |
| −0.279 | 0.279 | 4.621 |
| −0.278 | 0.280 | 4.621 |
| −0.276 | 0.281 | 4.621 |
| −0.275 | 0.281 | 4.621 |
| −0.273 | 0.281 | 4.621 |
| −0.272 | 0.281 | 4.621 |
| −0.270 | 0.281 | 4.621 |
| −0.269 | 0.280 | 4.621 |
| −0.267 | 0.279 | 4.621 |
| −0.266 | 0.278 | 4.621 |
| −0.265 | 0.277 | 4.621 |
| −0.265 | 0.276 | 4.621 |
| −0.264 | 0.274 | 4.621 |
| −0.263 | 0.273 | 4.621 |
| −0.262 | 0.271 | 4.621 |
| −0.262 | 0.270 | 4.621 |
| −0.261 | 0.268 | 4.621 |
| −0.260 | 0.267 | 4.621 |
| −0.260 | 0.266 | 4.621 |
| −0.259 | 0.264 | 4.621 |
| −0.258 | 0.263 | 4.621 |
| −0.258 | 0.261 | 4.621 |
| −0.254 | 0.254 | 4.621 |
| −0.250 | 0.247 | 4.621 |
| −0.247 | 0.240 | 4.621 |
| −0.243 | 0.233 | 4.621 |
| −0.239 | 0.226 | 4.621 |
| −0.235 | 0.219 | 4.621 |
| −0.231 | 0.212 | 4.621 |
| −0.227 | 0.205 | 4.621 |
| −0.223 | 0.198 | 4.621 |
| −0.218 | 0.191 | 4.621 |

TABLE 2-continued

| X | Y | Z |
|---|---|---|
| −0.214 | 0.184 | 4.621 |
| −0.210 | 0.178 | 4.621 |
| −0.205 | 0.171 | 4.621 |
| −0.201 | 0.164 | 4.621 |
| −0.197 | 0.158 | 4.621 |
| −0.192 | 0.151 | 4.621 |
| −0.187 | 0.144 | 4.621 |
| −0.183 | 0.138 | 4.621 |
| −0.178 | 0.131 | 4.621 |
| −0.173 | 0.125 | 4.621 |
| −0.169 | 0.118 | 4.621 |
| −0.164 | 0.112 | 4.621 |
| −0.159 | 0.106 | 4.621 |
| −0.154 | 0.099 | 4.621 |
| −0.149 | 0.093 | 4.621 |
| −0.144 | 0.087 | 4.621 |
| −0.139 | 0.080 | 4.621 |
| −0.134 | 0.074 | 4.621 |
| −0.129 | 0.068 | 4.621 |
| −0.123 | 0.062 | 4.621 |
| −0.118 | 0.056 | 4.621 |
| −0.113 | 0.050 | 4.621 |
| −0.107 | 0.044 | 4.621 |
| −0.102 | 0.038 | 4.621 |
| −0.096 | 0.033 | 4.621 |
| −0.090 | 0.027 | 4.621 |
| −0.085 | 0.021 | 4.621 |
| −0.079 | 0.016 | 4.621 |
| −0.073 | 0.010 | 4.621 |
| −0.067 | 0.005 | 4.621 |
| −0.061 | −0.001 | 4.621 |
| −0.055 | −0.006 | 4.621 |
| −0.049 | −0.011 | 4.621 |
| −0.043 | −0.016 | 4.621 |
| −0.036 | −0.021 | 4.621 |
| −0.030 | −0.026 | 4.621 |
| −0.023 | −0.030 | 4.621 |
| −0.017 | −0.035 | 4.621 |
| −0.010 | −0.039 | 4.621 |
| −0.003 | −0.044 | 4.621 |
| 0.004 | −0.048 | 4.621 |
| 0.011 | −0.052 | 4.621 |
| 0.018 | −0.055 | 4.621 |
| 0.025 | −0.059 | 4.621 |
| 0.032 | −0.062 | 4.621 |
| 0.040 | −0.065 | 4.621 |
| 0.047 | −0.068 | 4.621 |
| 0.055 | −0.071 | 4.621 |
| 0.062 | −0.073 | 4.621 |
| 0.070 | −0.075 | 4.621 |
| 0.078 | −0.077 | 4.621 |
| 0.086 | −0.078 | 4.621 |
| 0.094 | −0.079 | 4.621 |
| 0.102 | −0.080 | 4.621 |
| 0.110 | −0.080 | 4.621 |
| 0.118 | −0.080 | 4.621 |
| 0.126 | −0.080 | 4.621 |
| 0.134 | −0.079 | 4.621 |
| 0.142 | −0.078 | 4.621 |
| 0.150 | −0.077 | 4.621 |
| 0.158 | −0.075 | 4.621 |
| 0.166 | −0.073 | 4.621 |
| 0.173 | −0.071 | 4.621 |
| 0.181 | −0.068 | 4.621 |
| 0.188 | −0.065 | 4.621 |
| 0.196 | −0.062 | 4.621 |
| 0.203 | −0.059 | 4.621 |
| 0.210 | −0.055 | 4.621 |
| 0.217 | −0.052 | 4.621 |
| 0.219 | −0.051 | 4.621 |
| 0.220 | −0.050 | 4.621 |
| 0.221 | −0.049 | 4.621 |
| 0.223 | −0.048 | 4.621 |
| 0.224 | −0.048 | 4.621 |
| 0.226 | −0.047 | 4.621 |
| 0.227 | −0.046 | 4.621 |
| 0.228 | −0.045 | 4.621 |
| 0.230 | −0.044 | 4.621 |

TABLE 2-continued

| X | Y | Z |
|---|---|---|
| 0.231 | −0.043 | 4.621 |
| 0.234 | −0.042 | 4.621 |
| 0.237 | −0.040 | 4.621 |
| 0.240 | −0.039 | 4.621 |
| 0.243 | −0.038 | 4.621 |
| 0.247 | −0.038 | 4.621 |
| 0.250 | −0.038 | 4.621 |
| 0.253 | −0.038 | 4.621 |
| 0.256 | −0.039 | 4.621 |
| 0.259 | −0.041 | 4.621 |
| 0.262 | −0.043 | 4.621 |
| 0.264 | −0.045 | 4.621 |
| 0.266 | −0.048 | 4.621 |
| 0.267 | −0.051 | 4.621 |
| 0.268 | −0.054 | 4.621 |
| 0.268 | −0.058 | 4.621 |
| 0.268 | −0.061 | 4.621 |
| 0.268 | −0.064 | 4.621 |
| 0.267 | −0.068 | 4.621 |
| SECTION 9 | | |
| 0.250 | −0.132 | 4.761 |
| 0.249 | −0.134 | 4.761 |
| 0.249 | −0.136 | 4.761 |
| 0.248 | −0.138 | 4.761 |
| 0.247 | −0.141 | 4.761 |
| 0.246 | −0.143 | 4.761 |
| 0.246 | −0.145 | 4.761 |
| 0.245 | −0.147 | 4.761 |
| 0.244 | −0.149 | 4.761 |
| 0.243 | −0.151 | 4.761 |
| 0.243 | −0.154 | 4.761 |
| 0.238 | −0.164 | 4.761 |
| 0.234 | −0.175 | 4.761 |
| 0.229 | −0.185 | 4.761 |
| 0.224 | −0.195 | 4.761 |
| 0.219 | −0.205 | 4.761 |
| 0.213 | −0.215 | 4.761 |
| 0.207 | −0.225 | 4.761 |
| 0.201 | −0.235 | 4.761 |
| 0.195 | −0.244 | 4.761 |
| 0.188 | −0.253 | 4.761 |
| 0.181 | −0.262 | 4.761 |
| 0.174 | −0.271 | 4.761 |
| 0.166 | −0.279 | 4.761 |
| 0.158 | −0.287 | 4.761 |
| 0.149 | −0.294 | 4.761 |
| 0.139 | −0.300 | 4.761 |
| 0.129 | −0.305 | 4.761 |
| 0.118 | −0.310 | 4.761 |
| 0.108 | −0.313 | 4.761 |
| 0.097 | −0.316 | 4.761 |
| 0.085 | −0.317 | 4.761 |
| 0.074 | −0.317 | 4.761 |
| 0.062 | −0.316 | 4.761 |
| 0.051 | −0.314 | 4.761 |
| 0.040 | −0.311 | 4.761 |
| 0.029 | −0.308 | 4.761 |
| 0.019 | −0.303 | 4.761 |
| 0.009 | −0.297 | 4.761 |
| 0.000 | −0.291 | 4.761 |
| −0.009 | −0.284 | 4.761 |
| −0.017 | −0.276 | 4.761 |
| −0.024 | −0.267 | 4.761 |
| −0.031 | −0.258 | 4.761 |
| −0.037 | −0.248 | 4.761 |
| −0.042 | −0.238 | 4.761 |
| −0.047 | −0.228 | 4.761 |
| −0.052 | −0.217 | 4.761 |
| −0.057 | −0.207 | 4.761 |
| −0.061 | −0.196 | 4.761 |
| −0.066 | −0.186 | 4.761 |
| −0.070 | −0.175 | 4.761 |
| −0.074 | −0.165 | 4.761 |
| −0.078 | −0.154 | 4.761 |
| −0.082 | −0.144 | 4.761 |
| −0.087 | −0.133 | 4.761 |
| −0.091 | −0.122 | 4.761 |

TABLE 2-continued

| X | Y | Z |
|---|---|---|
| −0.095 | −0.112 | 4.761 |
| −0.099 | −0.101 | 4.761 |
| −0.103 | −0.091 | 4.761 |
| −0.107 | −0.080 | 4.761 |
| −0.111 | −0.069 | 4.761 |
| −0.116 | −0.059 | 4.761 |
| −0.120 | −0.048 | 4.761 |
| −0.124 | −0.038 | 4.761 |
| −0.128 | −0.027 | 4.761 |
| −0.132 | −0.016 | 4.761 |
| −0.137 | −0.006 | 4.761 |
| −0.141 | 0.005 | 4.761 |
| −0.145 | 0.015 | 4.761 |
| −0.150 | 0.026 | 4.761 |
| −0.154 | 0.036 | 4.761 |
| −0.159 | 0.047 | 4.761 |
| −0.163 | 0.057 | 4.761 |
| −0.167 | 0.068 | 4.761 |
| −0.172 | 0.078 | 4.761 |
| −0.176 | 0.089 | 4.761 |
| −0.181 | 0.099 | 4.761 |
| −0.185 | 0.110 | 4.761 |
| −0.190 | 0.120 | 4.761 |
| −0.195 | 0.130 | 4.761 |
| −0.199 | 0.141 | 4.761 |
| −0.204 | 0.151 | 4.761 |
| −0.208 | 0.162 | 4.761 |
| −0.213 | 0.172 | 4.761 |
| −0.218 | 0.182 | 4.761 |
| −0.222 | 0.193 | 4.761 |
| −0.227 | 0.203 | 4.761 |
| −0.231 | 0.214 | 4.761 |
| −0.236 | 0.224 | 4.761 |
| −0.237 | 0.226 | 4.761 |
| −0.238 | 0.228 | 4.761 |
| −0.238 | 0.230 | 4.761 |
| −0.239 | 0.233 | 4.761 |
| −0.240 | 0.235 | 4.761 |
| −0.241 | 0.237 | 4.761 |
| −0.242 | 0.239 | 4.761 |
| −0.243 | 0.241 | 4.761 |
| −0.243 | 0.243 | 4.761 |
| −0.244 | 0.245 | 4.761 |
| −0.244 | 0.247 | 4.761 |
| −0.244 | 0.249 | 4.761 |
| −0.244 | 0.250 | 4.761 |
| −0.244 | 0.252 | 4.761 |
| −0.243 | 0.253 | 4.761 |
| −0.243 | 0.254 | 4.761 |
| −0.242 | 0.256 | 4.761 |
| −0.240 | 0.257 | 4.761 |
| −0.239 | 0.258 | 4.761 |
| −0.238 | 0.258 | 4.761 |
| −0.236 | 0.259 | 4.761 |
| −0.235 | 0.259 | 4.761 |
| −0.233 | 0.259 | 4.761 |
| −0.231 | 0.258 | 4.761 |
| −0.230 | 0.258 | 4.761 |
| −0.229 | 0.257 | 4.761 |
| −0.227 | 0.256 | 4.761 |
| −0.226 | 0.255 | 4.761 |
| −0.226 | 0.253 | 4.761 |
| −0.225 | 0.252 | 4.761 |
| −0.224 | 0.250 | 4.761 |
| −0.224 | 0.249 | 4.761 |
| −0.223 | 0.248 | 4.761 |
| −0.222 | 0.246 | 4.761 |
| −0.222 | 0.245 | 4.761 |
| −0.221 | 0.244 | 4.761 |
| −0.220 | 0.242 | 4.761 |
| −0.220 | 0.241 | 4.761 |
| −0.219 | 0.239 | 4.761 |
| −0.216 | 0.233 | 4.761 |
| −0.212 | 0.226 | 4.761 |
| −0.209 | 0.219 | 4.761 |
| −0.205 | 0.212 | 4.761 |
| −0.201 | 0.206 | 4.761 |
| −0.197 | 0.199 | 4.761 |

TABLE 2-continued

| X | Y | Z |
|---|---|---|
| −0.194 | 0.192 | 4.761 |
| −0.190 | 0.185 | 4.761 |
| −0.186 | 0.179 | 4.761 |
| −0.182 | 0.172 | 4.761 |
| −0.178 | 0.166 | 4.761 |
| −0.175 | 0.159 | 4.761 |
| −0.171 | 0.152 | 4.761 |
| −0.167 | 0.146 | 4.761 |
| −0.163 | 0.139 | 4.761 |
| −0.159 | 0.133 | 4.761 |
| −0.155 | 0.126 | 4.761 |
| −0.151 | 0.119 | 4.761 |
| −0.147 | 0.113 | 4.761 |
| −0.143 | 0.106 | 4.761 |
| −0.139 | 0.100 | 4.761 |
| −0.135 | 0.093 | 4.761 |
| −0.131 | 0.087 | 4.761 |
| −0.127 | 0.080 | 4.761 |
| −0.123 | 0.074 | 4.761 |
| −0.119 | 0.068 | 4.761 |
| −0.114 | 0.061 | 4.761 |
| −0.110 | 0.055 | 4.761 |
| −0.106 | 0.048 | 4.761 |
| −0.102 | 0.042 | 4.761 |
| −0.097 | 0.036 | 4.761 |
| −0.093 | 0.030 | 4.761 |
| −0.088 | 0.023 | 4.761 |
| −0.084 | 0.017 | 4.761 |
| −0.079 | 0.011 | 4.761 |
| −0.075 | 0.005 | 4.761 |
| −0.070 | −0.001 | 4.761 |
| −0.065 | −0.007 | 4.761 |
| −0.061 | −0.013 | 4.761 |
| −0.056 | −0.019 | 4.761 |
| −0.051 | −0.025 | 4.761 |
| −0.046 | −0.031 | 4.761 |
| −0.041 | −0.037 | 4.761 |
| −0.036 | −0.042 | 4.761 |
| −0.030 | −0.048 | 4.761 |
| −0.025 | −0.053 | 4.761 |
| −0.020 | −0.059 | 4.761 |
| −0.014 | −0.064 | 4.761 |
| −0.008 | −0.069 | 4.761 |
| −0.003 | −0.074 | 4.761 |
| 0.003 | −0.079 | 4.761 |
| 0.009 | −0.084 | 4.761 |
| 0.015 | −0.089 | 4.761 |
| 0.021 | −0.093 | 4.761 |
| 0.028 | −0.098 | 4.761 |
| 0.034 | −0.102 | 4.761 |
| 0.041 | −0.106 | 4.761 |
| 0.047 | −0.109 | 4.761 |
| 0.054 | −0.113 | 4.761 |
| 0.061 | −0.116 | 4.761 |
| 0.068 | −0.119 | 4.761 |
| 0.076 | −0.122 | 4.761 |
| 0.083 | −0.124 | 4.761 |
| 0.090 | −0.126 | 4.761 |
| 0.098 | −0.127 | 4.761 |
| 0.105 | −0.129 | 4.761 |
| 0.113 | −0.130 | 4.761 |
| 0.121 | −0.130 | 4.761 |
| 0.128 | −0.130 | 4.761 |
| 0.136 | −0.130 | 4.761 |
| 0.143 | −0.129 | 4.761 |
| 0.151 | −0.128 | 4.761 |
| 0.159 | −0.127 | 4.761 |
| 0.166 | −0.125 | 4.761 |
| 0.173 | −0.123 | 4.761 |
| 0.181 | −0.121 | 4.761 |
| 0.188 | −0.118 | 4.761 |
| 0.195 | −0.115 | 4.761 |
| 0.202 | −0.112 | 4.761 |
| 0.203 | −0.111 | 4.761 |
| 0.205 | −0.110 | 4.761 |
| 0.206 | −0.110 | 4.761 |
| 0.207 | −0.109 | 4.761 |
| 0.209 | −0.108 | 4.761 |

TABLE 2-continued

| X | Y | Z |
|---|---|---|
| 0.210 | −0.107 | 4.761 |
| 0.211 | −0.107 | 4.761 |
| 0.213 | −0.106 | 4.761 |
| 0.214 | −0.105 | 4.761 |
| 0.215 | −0.104 | 4.761 |
| 0.218 | −0.103 | 4.761 |
| 0.221 | −0.102 | 4.761 |
| 0.224 | −0.101 | 4.761 |
| 0.228 | −0.100 | 4.761 |
| 0.231 | −0.099 | 4.761 |
| 0.234 | −0.099 | 4.761 |
| 0.237 | −0.100 | 4.761 |
| 0.240 | −0.101 | 4.761 |
| 0.243 | −0.102 | 4.761 |
| 0.246 | −0.104 | 4.761 |
| 0.248 | −0.107 | 4.761 |
| 0.250 | −0.110 | 4.761 |
| 0.251 | −0.113 | 4.761 |
| 0.251 | −0.116 | 4.761 |
| 0.252 | −0.119 | 4.761 |
| 0.252 | −0.122 | 4.761 |
| 0.251 | −0.126 | 4.761 |
| 0.251 | −0.129 | 4.761 |
| SECTION 10 | | |
| 0.225 | −0.234 | 4.976 |
| 0.224 | −0.236 | 4.976 |
| 0.224 | −0.239 | 4.976 |
| 0.223 | −0.241 | 4.976 |
| 0.222 | −0.243 | 4.976 |
| 0.221 | −0.245 | 4.976 |
| 0.220 | −0.247 | 4.976 |
| 0.219 | −0.249 | 4.976 |
| 0.219 | −0.251 | 4.976 |
| 0.218 | −0.252 | 4.976 |
| 0.217 | −0.254 | 4.976 |
| 0.212 | −0.264 | 4.976 |
| 0.207 | −0.274 | 4.976 |
| 0.201 | −0.283 | 4.976 |
| 0.196 | −0.292 | 4.976 |
| 0.190 | −0.302 | 4.976 |
| 0.184 | −0.311 | 4.976 |
| 0.179 | −0.320 | 4.976 |
| 0.172 | −0.329 | 4.976 |
| 0.166 | −0.338 | 4.976 |
| 0.159 | −0.346 | 4.976 |
| 0.152 | −0.354 | 4.976 |
| 0.144 | −0.361 | 4.976 |
| 0.135 | −0.368 | 4.976 |
| 0.126 | −0.373 | 4.976 |
| 0.116 | −0.377 | 4.976 |
| 0.105 | −0.380 | 4.976 |
| 0.095 | −0.382 | 4.976 |
| 0.084 | −0.382 | 4.976 |
| 0.073 | −0.381 | 4.976 |
| 0.063 | −0.379 | 4.976 |
| 0.052 | −0.376 | 4.976 |
| 0.042 | −0.373 | 4.976 |
| 0.032 | −0.368 | 4.976 |
| 0.023 | −0.362 | 4.976 |
| 0.014 | −0.356 | 4.976 |
| 0.006 | −0.349 | 4.976 |
| −0.002 | −0.341 | 4.976 |
| −0.008 | −0.333 | 4.976 |
| −0.014 | −0.324 | 4.976 |
| −0.020 | −0.314 | 4.976 |
| −0.024 | −0.304 | 4.976 |
| −0.027 | −0.294 | 4.976 |
| −0.030 | −0.284 | 4.976 |
| −0.032 | −0.273 | 4.976 |
| −0.033 | −0.262 | 4.976 |
| −0.035 | −0.251 | 4.976 |
| −0.036 | −0.241 | 4.976 |
| −0.037 | −0.230 | 4.976 |
| −0.038 | −0.219 | 4.976 |
| −0.039 | −0.208 | 4.976 |
| −0.040 | −0.198 | 4.976 |
| −0.042 | −0.187 | 4.976 |

TABLE 2-continued

| X | Y | Z |
|---|---|---|
| −0.043 | −0.176 | 4.976 |
| −0.045 | −0.166 | 4.976 |
| −0.047 | −0.155 | 4.976 |
| −0.049 | −0.144 | 4.976 |
| −0.052 | −0.134 | 4.976 |
| −0.055 | −0.123 | 4.976 |
| −0.057 | −0.113 | 4.976 |
| −0.060 | −0.102 | 4.976 |
| −0.063 | −0.092 | 4.976 |
| −0.067 | −0.082 | 4.976 |
| −0.070 | −0.071 | 4.976 |
| −0.073 | −0.061 | 4.976 |
| −0.077 | −0.051 | 4.976 |
| −0.080 | −0.041 | 4.976 |
| −0.084 | −0.030 | 4.976 |
| −0.088 | −0.020 | 4.976 |
| −0.091 | −0.010 | 4.976 |
| −0.095 | 0.000 | 4.976 |
| −0.099 | 0.010 | 4.976 |
| −0.103 | 0.020 | 4.976 |
| −0.107 | 0.030 | 4.976 |
| −0.110 | 0.041 | 4.976 |
| −0.114 | 0.051 | 4.976 |
| −0.118 | 0.061 | 4.976 |
| −0.122 | 0.071 | 4.976 |
| −0.126 | 0.081 | 4.976 |
| −0.130 | 0.091 | 4.976 |
| −0.134 | 0.101 | 4.976 |
| −0.138 | 0.111 | 4.976 |
| −0.142 | 0.121 | 4.976 |
| −0.147 | 0.131 | 4.976 |
| −0.151 | 0.141 | 4.976 |
| −0.155 | 0.151 | 4.976 |
| −0.160 | 0.161 | 4.976 |
| −0.164 | 0.171 | 4.976 |
| −0.169 | 0.180 | 4.976 |
| −0.174 | 0.190 | 4.976 |
| −0.175 | 0.192 | 4.976 |
| −0.176 | 0.194 | 4.976 |
| −0.177 | 0.196 | 4.976 |
| −0.178 | 0.198 | 4.976 |
| −0.179 | 0.200 | 4.976 |
| −0.180 | 0.202 | 4.976 |
| −0.180 | 0.204 | 4.976 |
| −0.181 | 0.206 | 4.976 |
| −0.182 | 0.208 | 4.976 |
| −0.183 | 0.210 | 4.976 |
| −0.183 | 0.211 | 4.976 |
| −0.183 | 0.213 | 4.976 |
| −0.183 | 0.214 | 4.976 |
| −0.183 | 0.216 | 4.976 |
| −0.182 | 0.217 | 4.976 |
| −0.181 | 0.219 | 4.976 |
| −0.180 | 0.220 | 4.976 |
| −0.179 | 0.221 | 4.976 |
| −0.178 | 0.222 | 4.976 |
| −0.176 | 0.223 | 4.976 |
| −0.174 | 0.223 | 4.976 |
| −0.173 | 0.223 | 4.976 |
| −0.171 | 0.223 | 4.976 |
| −0.170 | 0.222 | 4.976 |
| −0.168 | 0.222 | 4.976 |
| −0.167 | 0.221 | 4.976 |
| −0.166 | 0.220 | 4.976 |
| −0.165 | 0.219 | 4.976 |
| −0.164 | 0.217 | 4.976 |
| −0.163 | 0.216 | 4.976 |
| −0.163 | 0.215 | 4.976 |
| −0.162 | 0.213 | 4.976 |
| −0.161 | 0.212 | 4.976 |
| −0.161 | 0.211 | 4.976 |
| −0.160 | 0.209 | 4.976 |
| −0.159 | 0.208 | 4.976 |
| −0.159 | 0.207 | 4.976 |
| −0.158 | 0.205 | 4.976 |
| −0.157 | 0.204 | 4.976 |
| −0.154 | 0.198 | 4.976 |
| −0.150 | 0.191 | 4.976 |

TABLE 2-continued

| X | Y | Z |
|---|---|---|
| −0.147 | 0.185 | 4.976 |
| −0.143 | 0.178 | 4.976 |
| −0.140 | 0.172 | 4.976 |
| −0.136 | 0.165 | 4.976 |
| −0.132 | 0.159 | 4.976 |
| −0.129 | 0.153 | 4.976 |
| −0.126 | 0.146 | 4.976 |
| −0.122 | 0.139 | 4.976 |
| −0.119 | 0.133 | 4.976 |
| −0.116 | 0.126 | 4.976 |
| −0.113 | 0.120 | 4.976 |
| −0.110 | 0.113 | 4.976 |
| −0.106 | 0.106 | 4.976 |
| −0.104 | 0.099 | 4.976 |
| −0.101 | 0.093 | 4.976 |
| −0.098 | 0.086 | 4.976 |
| −0.095 | 0.079 | 4.976 |
| −0.092 | 0.072 | 4.976 |
| −0.089 | 0.066 | 4.976 |
| −0.086 | 0.059 | 4.976 |
| −0.084 | 0.052 | 4.976 |
| −0.081 | 0.045 | 4.976 |
| −0.078 | 0.038 | 4.976 |
| −0.075 | 0.032 | 4.976 |
| −0.072 | 0.025 | 4.976 |
| −0.070 | 0.018 | 4.976 |
| −0.067 | 0.011 | 4.976 |
| −0.064 | 0.004 | 4.976 |
| −0.061 | −0.003 | 4.976 |
| −0.058 | −0.009 | 4.976 |
| −0.056 | −0.016 | 4.976 |
| −0.053 | −0.023 | 4.976 |
| −0.050 | −0.030 | 4.976 |
| −0.047 | −0.036 | 4.976 |
| −0.044 | −0.043 | 4.976 |
| −0.041 | −0.050 | 4.976 |
| −0.038 | −0.056 | 4.976 |
| −0.035 | −0.063 | 4.976 |
| −0.031 | −0.070 | 4.976 |
| −0.028 | −0.076 | 4.976 |
| −0.025 | −0.083 | 4.976 |
| −0.021 | −0.089 | 4.976 |
| −0.018 | −0.096 | 4.976 |
| −0.014 | −0.102 | 4.976 |
| −0.011 | −0.109 | 4.976 |
| −0.007 | −0.115 | 4.976 |
| −0.003 | −0.121 | 4.976 |
| 0.001 | −0.128 | 4.976 |
| 0.005 | −0.134 | 4.976 |
| 0.009 | −0.140 | 4.976 |
| 0.013 | −0.146 | 4.976 |
| 0.018 | −0.152 | 4.976 |
| 0.022 | −0.157 | 4.976 |
| 0.027 | −0.163 | 4.976 |
| 0.032 | −0.168 | 4.976 |
| 0.037 | −0.174 | 4.976 |
| 0.042 | −0.179 | 4.976 |
| 0.048 | −0.184 | 4.976 |
| 0.054 | −0.188 | 4.976 |
| 0.060 | −0.193 | 4.976 |
| 0.066 | −0.197 | 4.976 |
| 0.072 | −0.201 | 4.976 |
| 0.078 | −0.204 | 4.976 |
| 0.085 | −0.207 | 4.976 |
| 0.092 | −0.210 | 4.976 |
| 0.099 | −0.213 | 4.976 |
| 0.106 | −0.215 | 4.976 |
| 0.113 | −0.216 | 4.976 |
| 0.120 | −0.218 | 4.976 |
| 0.127 | −0.219 | 4.976 |
| 0.135 | −0.219 | 4.976 |
| 0.142 | −0.219 | 4.976 |
| 0.150 | −0.218 | 4.976 |
| 0.157 | −0.218 | 4.976 |
| 0.164 | −0.216 | 4.976 |
| 0.171 | −0.214 | 4.976 |
| 0.178 | −0.212 | 4.976 |
| 0.180 | −0.212 | 4.976 |

TABLE 2-continued

| X | Y | Z |
|---|---|---|
| 0.181 | −0.211 | 4.976 |
| 0.182 | −0.211 | 4.976 |
| 0.184 | −0.210 | 4.976 |
| 0.185 | −0.209 | 4.976 |
| 0.186 | −0.209 | 4.976 |
| 0.188 | −0.208 | 4.976 |
| 0.189 | −0.208 | 4.976 |
| 0.190 | −0.207 | 4.976 |
| 0.192 | −0.206 | 4.976 |
| 0.195 | −0.205 | 4.976 |
| 0.198 | −0.204 | 4.976 |
| 0.201 | −0.203 | 4.976 |
| 0.204 | −0.202 | 4.976 |
| 0.207 | −0.202 | 4.976 |
| 0.210 | −0.202 | 4.976 |
| 0.213 | −0.203 | 4.976 |
| 0.216 | −0.204 | 4.976 |
| 0.219 | −0.205 | 4.976 |
| 0.222 | −0.207 | 4.976 |
| 0.224 | −0.210 | 4.976 |
| 0.225 | −0.213 | 4.976 |
| 0.226 | −0.216 | 4.976 |
| 0.227 | −0.219 | 4.976 |
| 0.227 | −0.222 | 4.976 |
| 0.227 | −0.225 | 4.976 |
| 0.227 | −0.228 | 4.976 |
| 0.226 | −0.231 | 4.976 |

It should be understood that the finished compressor turbine blade 42 does not necessarily include all the sections defined in Table 2. The portion of the airfoil 54 proximal to the platform 60 and tip 62 may not be defined by a profile section 66. It should be considered that the blade 42 airfoil profile proximal to the platform 60 may vary due to several imposed constraints. However, the blade 42 has an intermediate airfoil portion 64 defined between platform 60 and tip 62 thereof and which has a profile defined on the basis of at least the intermediate sections of the various vane profile sections 66 defined in Table 2.

It should be appreciated that the intermediate airfoil portion 64 of the compressor turbine blade 42 is defined between the inner and outer gaspath walls 28 and 30 and that the platform 60 forms part of the inner gaspath wall 28. The airfoil profile physically appearing on the compressor turbine blade 42 and fully contained in the gaspath includes Sections 2 to 9 of Table 2. The remaining sections are at least partly located outside of the gaspath 27, but are provided, in part, to fully define the airfoil surface and/or, in part, to improve curve-fitting of the airfoil at its radially inner end portion. The skilled reader will appreciate that a suitable fillet radius is to be applied between the platform 60 and the airfoil portion of the blade. The blade inner diameter endwall fillet is in the range of about 0.060" to about 0.090".

Figure 4:
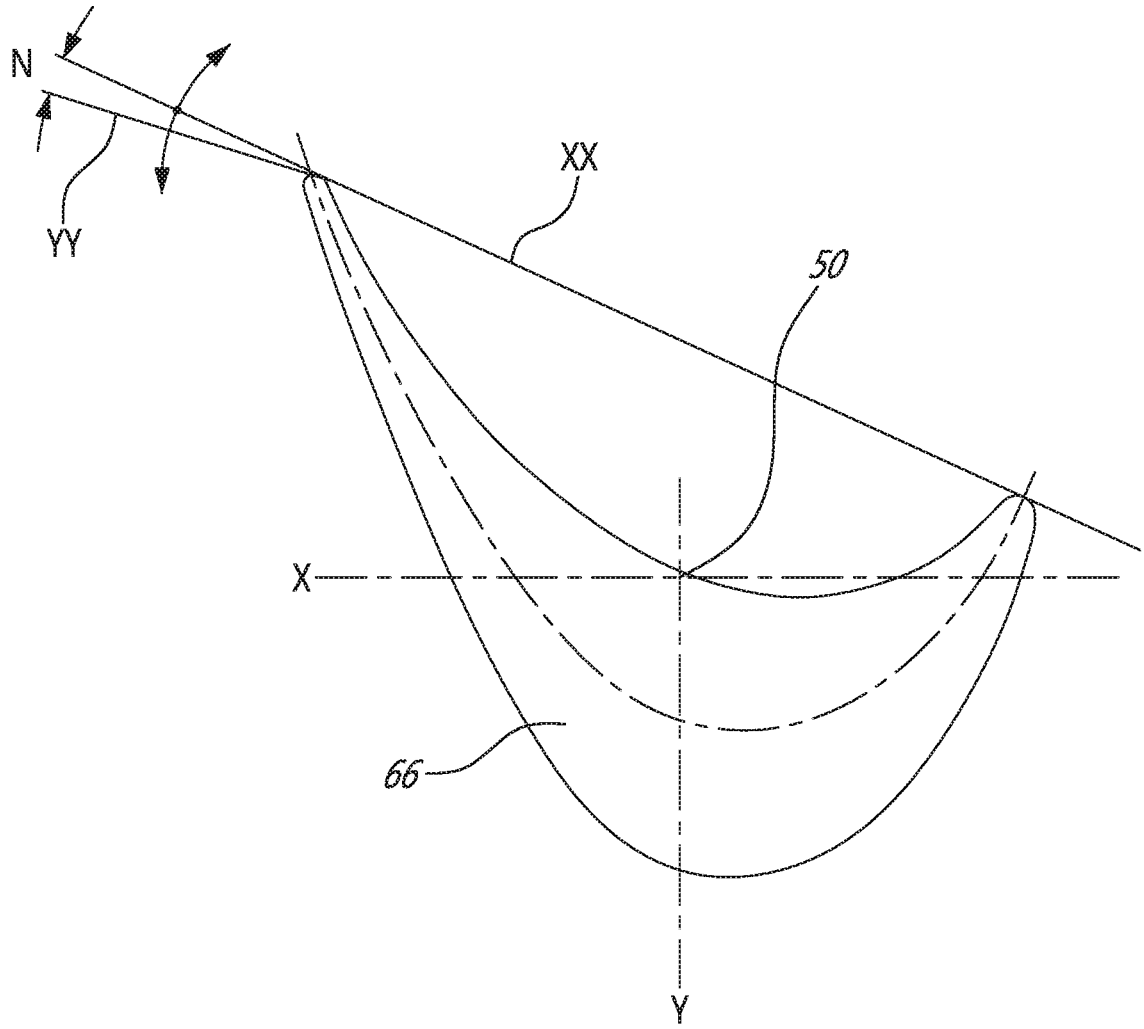
FIG. 4 is a schematic compressor turbine blade airfoil section illustrating the angular twist and its tolerances.

FIG. 4 illustrates the tolerances on the twist angle. The twist "N" is an angular position of each blade section with respect to a reference blade section. The twist angle is defined by the section chord line XX and the reference section chord line YY. The section twist "N" has a tolerance of +/−0.99 degrees.

The above description is meant to be exemplary only, and one skilled in the art will recognize that changes may be made to the embodiments described without department from the scope of the invention disclosed. Other modifications which fall within the scope of the present invention will be apparent to those skilled in the art, in light of a review of this disclosure, and such modifications are intended to fall within the appended claims.

The invention claimed is:

1. A turbine blade of a gas turbine engine having a gaspath, the turbine blade comprising an airfoil having an intermediate portion contained within the gaspath and defined by a nominal profile substantially in accordance with Cartesian coordinate values of X, Y, and Z of Sections 2 to 9 set forth in Table 2, wherein the point of origin of the orthogonally related axes X, Y and Z is located at an intersection of a centerline of the gas turbine engine and a stacking line of the turbine blade, the Z values are radial distances measured along the stacking line, the X and Y are coordinate values defining the profile at each distance Z.

2. The turbine blade as defined in claim 1, wherein the blade is a compressor turbine blade.

3. The turbine blade as defined in claim 2, wherein the blade is a single-stage compressor turbine blade.

4. The turbine blade as defined in claim 1, wherein the nominal profile defining the intermediate portion is for a cold coated airfoil, and wherein the cold coating has a thickness of 0.001 to 0.002 inches.

5. A compressor turbine blade for a gas turbine engine having a gaspath, the compressor turbine blade having a cold coated intermediate airfoil portion contained within the gaspath and defined by a nominal profile substantially in accordance with Cartesian coordinate values of X, Y, and Z of Sections 2 to 9 set forth in Table 2, wherein the point of origin of the orthogonally related axes X, Y and Z is located at an intersection of a centerline of the gas turbine engine and a stacking line of the compressor turbine blade, the Z values are radial distances measured along the stacking line, the X and Y are coordinate values defining the profile at each distance Z.

6. The compressor turbine blade as defined in claim 5, wherein the compressor turbine blade is a single-stage compressor turbine blade.

7. The compressor turbine blade as defined in claim 5, wherein the cold coating has a thickness ranging from 0.001 to 0.002 inches.

8. A turbine rotor assembly for a gas turbine engine having a gaspath, the turbine rotor assembly comprising a plurality of blades, each blade including an airfoil having an intermediate portion contained within the gaspath and defined by a nominal profile substantially in accordance with Cartesian coordinate values of X, Y, and Z of Sections 2 to 9 set forth in Table 2, wherein the point of origin of the orthogonally related axes X, Y and Z is located at an intersection of a centerline of the gas turbine engine and a stacking line of the turbine blade, the Z values are radial distances measured along the stacking line, the X and Y are coordinate values defining the profile at each distance Z.

* * * * *